US007603280B2

(12) United States Patent
Hirota et al.

(10) Patent No.: US 7,603,280 B2
(45) Date of Patent: Oct. 13, 2009

(54) SPEECH OUTPUT APPARATUS, SPEECH OUTPUT METHOD, AND PROGRAM

(75) Inventors: Makoto Hirota, Kanagawa (JP); Hideo Kuboyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 531 days.

(21) Appl. No.: 11/612,603

(22) Filed: Dec. 19, 2006

(65) Prior Publication Data

US 2007/0088539 A1 Apr. 19, 2007

Related U.S. Application Data

(62) Division of application No. 10/216,753, filed on Aug. 13, 2002, now Pat. No. 7,203,647.

(30) Foreign Application Priority Data

Aug. 21, 2001 (JP) ..... 2001-250409
Aug. 21, 2001 (JP) ..... 2001-250410
Aug. 21, 2001 (JP) ..... 2001-250412

(51) Int. Cl.
*G10L 11/00* (2006.01)

(52) U.S. Cl. ..... 704/278; 704/267; 704/258; 704/270; 704/272

(58) Field of Classification Search ..... 704/278, 704/267, 258, 270, 272
See application file for complete search history.

(56) References Cited

U.S. PATENT DOCUMENTS

| | | | | |
|---|---|---|---|---|
| 5,548,681 | A * | 8/1996 | Gleaves et al. | 704/233 |
| 5,844,158 | A | 12/1998 | Butler et al. | |
| 5,850,629 | A | 12/1998 | Holm et al. | |
| 5,915,237 | A | 6/1999 | Boss et al. | |
| 6,740,802 | B1 | 5/2004 | Browne, Jr. | |
| 2002/0048361 | A1 * | 4/2002 | Case et al. | 379/387.01 |
| 2003/0074196 | A1 | 4/2003 | Kamanaka | |

* cited by examiner

*Primary Examiner*—Qi Han
(74) *Attorney, Agent, or Firm*—Fitzpatrick, Cella, Harper & Scinto

(57) ABSTRACT

A speech output apparatus is disclosed, which can allow the user to easily catch synthetic speech when the synthetic speech is output upon being superposed on a music output. The apparatus output can output a music and synthetic speech that indicates contents of information such as an e-mail and is superposed on the music. When the synthetic speech is output to be superposed on the music during output, the apparatus gradually decreases a tone volume of the music.

19 Claims, 28 Drawing Sheets

FIG. 16

| MUSIC TITLE ID | GENDER OF VOCALIST |
|---|---|
| 1 | FEMALE |
| 2 | MALE |
| 3 | MALE |
| 4 | MALE |
| 5 | FEMALE |
| 6 | FEMALE |
| 7 | FEMALE |

FIG. 17

| MUSIC TITLE ID | TYPE OF VOICE QUALITY |
|---|---|
| 1 | MALE 1 |
| 2 | FEMALE 3 |
| 3 | FEMALE 1 |
| 4 | FEMALE 1 |
| 5 | MALE 2 |

FIG. 30

```
< title > ○×MURDER, SHE WROTE < /title >
< chapter name = "PROLOGUE" >
< paragraph >
- - - - - - - - - - - - - - - - - - - - - - - - - - - - - - - - - - - - - - - - - - - -
- - - - - - - - - - - - - - - - - - - - - - - - - - - - - - - - - - - - - - - - - - - -
< /paragraph >
< paragraph >
- - - - - - - - - - - - - - - - - - - - - - - - - - - - - - - - - - - - - - - - - - - -
- - - - - - - - - - - - - - - - - - - - - - - - - - - - - - - - - - - - - - - - - - - -
< /paragraph >
< chapter >
< chapter name = "7/1: FIRST DAY" >
< paragraph >
- - - - - - - - - - - - - - - - - - - - - - - - - - - - - - - - - - - - - - - - - - - -
- - - - - - - - - - - - - - - - - - - - - - - - - - - - - - - - - - - - - - - - - - - -
< /paragraph >
< paragraph >
- - - - - - - - - - - - - - - - - - - - - - - - - - - - - - - - - - - - - - - - - - - -
- - - - - - - - - - - - - - - - - - - - - - - - - - - - - - - - - - - - - - - - - - - -
```

SPEECH OUTPUT APPARATUS, SPEECH OUTPUT METHOD, AND PROGRAM

This is a divisional application of application Ser. No. 10/216,753, filed Aug. 13, 2002, now allowed.

FIELD OF THE INVENTION

The present invention relates to a technique for outputting various kinds of information such as an e-mail message, news article, and the like by synthesizing speech.

BACKGROUND OF THE INVENTION

Along with the development of communication techniques represented by the Internet, delivery of news articles on a network and e-mail have prevailed. Since it is desirable to quickly offer such information to the user, terminal devices such as a personal computer, portable phone, and the like, which can inform the user of incoming information, have been proposed. Also, a terminal device which not only displays such information on a display but also outputs it by synthesizing speech has also been proposed.

The speech output requires user's attention less than display on the display. Hence, the user can hear the output speech to confirm the contents of information while he or she does something else.

However, the speech output using such synthetic speech poses a problem when the user is listening to another audio such as music or the like by the terminal device. For example, when the contents of a received e-mail message are read using synthetic speech which is superposed on a piece of music while the user is listening to the music, the user may hardly catch the synthetic speech. On the other hand, if the contents of the received e-mail message are suddenly read while the user is listening to the music, such operation may suddenly spoil user's pleasure.

SUMMARY OF THE INVENTION

It is the first object of the present invention to allow the user to easily catch synthetic speech when the synthetic speech is output upon being superposed on a music output.

It is the second object of the present invention to output various kinds of information by synthesizing speech while minimizing the influence on another audio output.

In order to achieve the first object, according to the present invention, there is provided a speech output apparatus comprising:

output means which can output a music and synthetic speech that indicates contents of information and is superposed on the music; and control means for controlling a tone volume of the music to be output, wherein the control means gradually decreases the tone volume of the music when the synthetic speech is output to be superposed on the music during output.

According to the present invention, there is provided a speech output method comprising:

the output step of outputting a music and synthetic speech that indicates contents of information and is superposed on the music; and the step of gradually decreasing a tone volume of the music when the synthetic speech is output to be superposed on the music during output.

According to the present invention, there is provided a program for making a computer execute:

the step of outputting a music and synthetic speech that indicates contents of information and is superposed on the music; and the step of gradually decreasing a tone volume of the music when the synthetic speech is output to be superposed on the music during output.

According to the present invention, there is provided a speech output apparatus comprising:

output means which can output a music and synthetic speech that indicates contents of information and is superposed on the music; and setting means for setting a voice quality of the synthetic speech in accordance with a music to be output.

According to the present invention, there is provided a speech output method comprising:

the output step of outputting a music and synthetic speech that indicates contents of information and is superposed on the music; and the setting step of setting a voice quality of the synthetic speech in accordance with a music to be output.

According to the present invention, there is provided a program for making a computer execute:

the output step of outputting a music and synthetic speech that indicates contents of information and is superposed on the music; and the setting step of setting voice quality of the synthetic speech in accordance with a music to be output.

In order to achieve the second object, according to the present invention, there is provided a speech output apparatus comprising:

conversion means for converting character data into synthetic speech data;

output means for outputting a music and synthetic speech based on the synthetic speech data; and control means for controlling an output timing of the synthetic speech, wherein the control means begins to output the synthetic speech after completion of output of a tune which is being output.

According to the present invention, there is provided a speech output apparatus comprising:

conversion means for converting character data into synthetic speech data;

output means for outputting synthetic speech based on the synthetic speech data; and control means for controlling an output timing of the synthetic speech, wherein when the synthetic speech indicating contents of another information is to be output during output of the synthetic speech indicating contents of an e-book, the control means begins to output the synthetic speech of the other information in a break of a document of the e-book which is being output.

According to the present invention, there is provided a speech output method comprising:

the conversion step of converting character data into synthetic speech data;

the output step of outputting a music and synthetic speech based on the synthetic speech data; and the control step of controlling an output timing of the synthetic speech, wherein the control step includes the step of beginning to output the synthetic speech after completion of output of a tune which is being output.

According to the present invention, there is provided a speech output method comprising:

the conversion step of converting character data into synthetic speech data;

the output step of outputting synthetic speech based on the synthetic speech data; and the control step of controlling an output timing of the synthetic speech, wherein the control step includes the step of beginning, when the synthetic speech indicating contents of another information is to be output during output of the synthetic speech indicating contents of an e-book, to output the synthetic speech of the other information in a break of a document of the e-book which is being output.

According to the present invention, there is provided a program for making a computer to execute:

in order to control an output timing of synthetic speech indicating contents of information upon outputting the synthetic speech and a music, the step of checking if the music is being output; and the step of beginning, when it is determined that the music is being output, to output the synthetic speech after the end of a tune which is being output.

According to the present invention, there is provided a program for making a computer to execute:

in order to control an output timing of synthetic speech indicating contents of information upon outputting the synthetic speech indicating the contents of the information, and synthetic speech indicating contents of an e-book, the step of checking if the synthetic speech indicating the contents of the e-book is being output; and the step of beginning, when it is determined that the synthetic speech indicating the contents of the e-book is being output, to output the synthetic speech indicating the contents of the information in a break of a document of the e-book which is being output.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 16 shows an example of a table showing music titles and the genders of vocalists in the second embodiment of the present invention;

FIG. 17 shows an example of a table showing music titles and the types of vocal quality of synthetic speech set in correspondence with these music titles in the second embodiment of the present invention;

FIG. 30 shows an example of e-book data in the third embodiment of the present invention

DETAILED DESCRIPTION OF THE PREFERRED EMBODIMENTS

Preferred embodiments of the present invention will now be described in detail in accordance with the accompanying drawings.

Common Embodiment

<System Arrangement>

Figure 1:
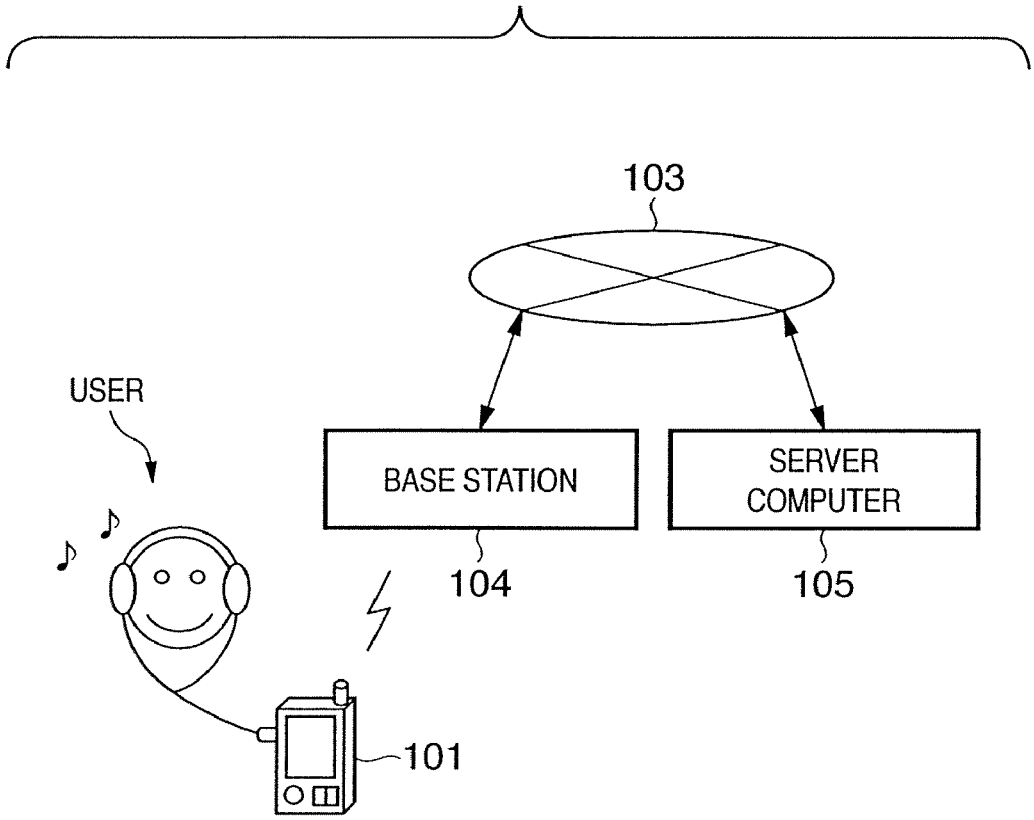
FIG. 1 shows an example of a system in which a speech output apparatus 101 according to an embodiment of the present invention is used.

FIG. 1 shows an example of a system in which a speech output apparatus 101 according to an embodiment of the present invention is used.

Referring to FIG. 1, a server computer 105 is a server which provides various kinds of information such as news articles, e-mail messages, and the like to a user terminal via a network 103 represented by the Internet, and corresponds to a delivery server or mail server. FIG. 1 illustrates only one server computer 105, but a plurality of servers may be connected to the network 103. A base station 104 receives information sent from the server computer 105, and sends it to a speech output apparatus 101 via wireless communications. The speech output apparatus 101 receives information provided from, e.g., the server computer 105 on the network via the base station 104, and can provide it to the user. As will be described later, in this embodiment, the speech output apparatus 101 can provide the received information to the user by audibly outputting it using synthetic speech.

<Arrangement of Speech Output Apparatus>

Figure 2:
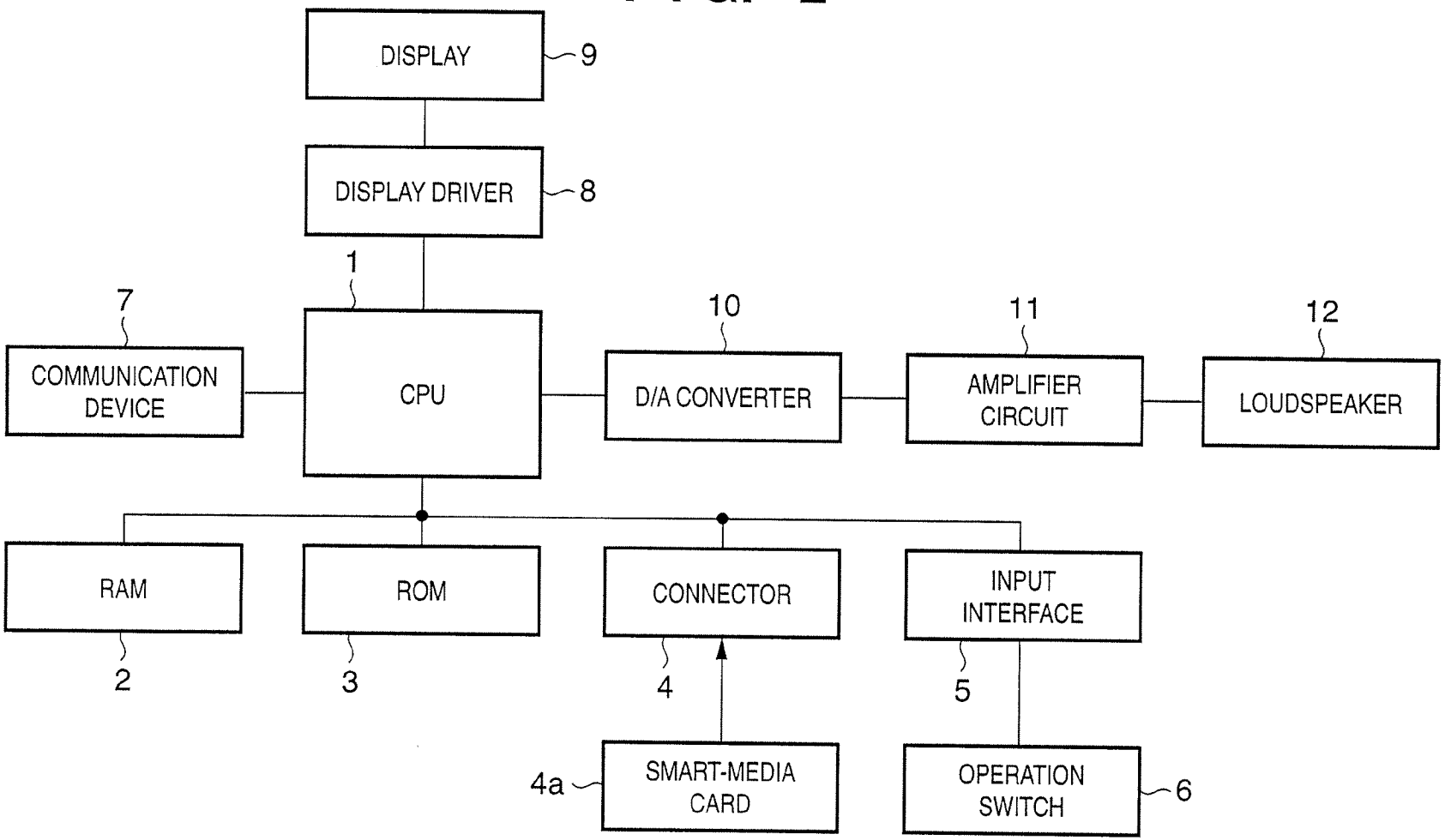
FIG. 2 is a block diagram showing an example of the hardware arrangement of the speech output apparatus 101.

FIG. 2 is a block diagram showing an example of the hardware arrangement of the speech output apparatus 101. The speech output apparatus 101 is preferably implemented as a portable terminal such as a portable phone, mobile computer, or the like, but can also be implemented as a personal computer or the like.

A CPU 1 controls the entire speech output apparatus 101, and especially executes processes to be described later in this embodiment. A RAM 2 is a memory used as a work area of the CPU 1. A ROM 3 is a memory that stores permanent data such as control programs to be executed by the CPU 1, and data used in the process of the program.

The ROM 3 stores music playback software such as a decoder program for playing back audio data, conversion software for converting character data such as text data or the like into synthetic speech data, dictionary data for synthetic speech used upon converting character data into synthetic speech data, and the like. Such software programs and dictionary data can use known ones.

A smart-media card 4 a is inserted into a connector 4, and is used as a memory that can be accessed by the CPU 1. The smart-media card 4*a* stores, e.g., audio data.

In this embodiment, the RAM 2, ROM 3, and smart-media card 4*a* are used as memories of the CPU 1. Also, other types of memories may be used.

An input interface 5 serves as an interface between the CPU 1 and an operation switch 6. The operation switch 6 is used by the user to supply an instruction to the speech output apparatus 101, and comprises a key switch and the like.

A communication device 7 has electronic circuits such as an RF circuit and the like used to make wireless communications with the base station 104. This embodiment assumes wireless communications, but wired communications may be used. In this case, a network interface or the like may be adopted as the communication device 7. The CPU 1 can acquire various kinds of information provided from the network 103 via the communication device 7. A display 9 comprises a liquid crystal display device or the like, and undergoes display control of the CPU 1 via a display driver 8.

A D/A converter 10 is a circuit for converting a digital signal into an analog signal. In this embodiment, the D/A converter 10 is used to convert digital speech data output from the CPU 1 into an analog signal. An amplifier circuit 11 amplifies an analog signal output from the D/A converter 10. A loudspeaker 12 outputs the analog signal output from the amplifier circuit 11 as actual speech, and comprises, e.g., a headphone or the like.

First Embodiment

<Operation to Speech Output Apparatus>

Figure 3:
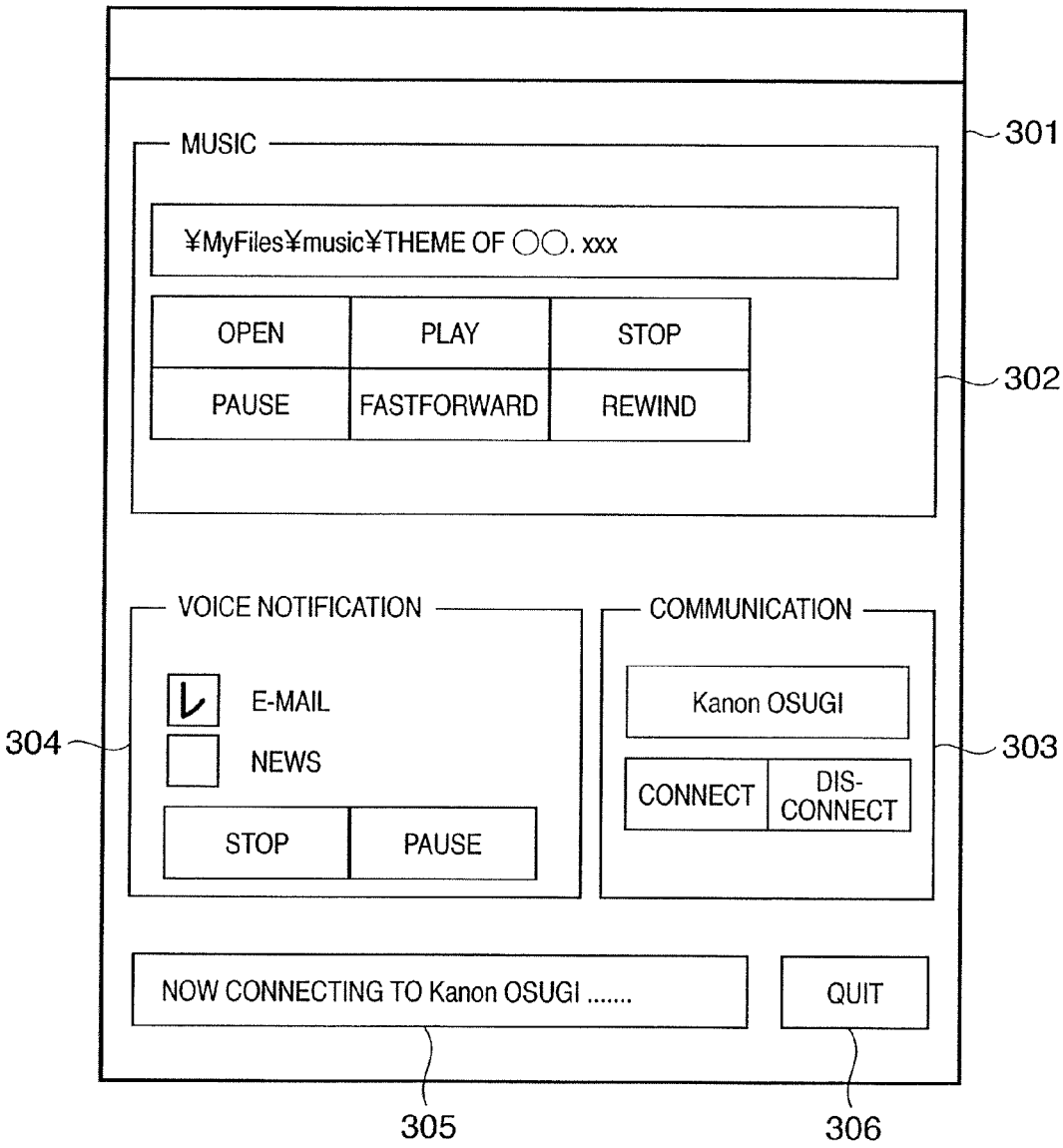
FIG. 3 shows an example of an operation selection window displayed on a display 9 in the first embodiment of the present invention.

FIG. 3 shows an example of an operation selection window displayed on the display 9 in the first embodiment of the present invention. On an application window 301, displays used to make various operations are made. The user can issue various instructions in accordance with respective display areas by operating the aforementioned operation switch 6.

On a music playback operation area 302, an input field for designating a music data file to be played back, and buttons used to play, stop, pause, fastforward, and rewind music are displayed.

On a communication setup operation area 303, an input field for designating a destination of connection, and buttons used to instruct to establish and release connection are displayed.

An operation area 304 is used to set if information received from the network 103 is to be converted into synthetic speech to be output. The operation area 304 includes check boxes for e-mail and news. Upon receiving information corresponding to the checked check box, that information can be converted into synthetic speech to be output.

In FIG. 3, since the e-mail check box is checked, when an e-mail message is received, its contents are converted into synthetic speech to be output. Also, on the operation area 304, buttons used to stop or pause the output of synthetic speech are displayed.

A status display field 305 displays information indicating the current status of the speech output apparatus 101, and a quit button 306 is used to instruct to quit this application.

Upon selecting a process on the display window shown in FIG. 3, the user can listen to his or her favorite music or hear synthetic speech by reading the contents of a news or e-mail message received from the network 103 via the base station 104.

The processes to be executed by the speech output apparatus 101 in the first embodiment of the present invention will be described below.

<Synthetic Speech Conversion Process>

Figure 4:
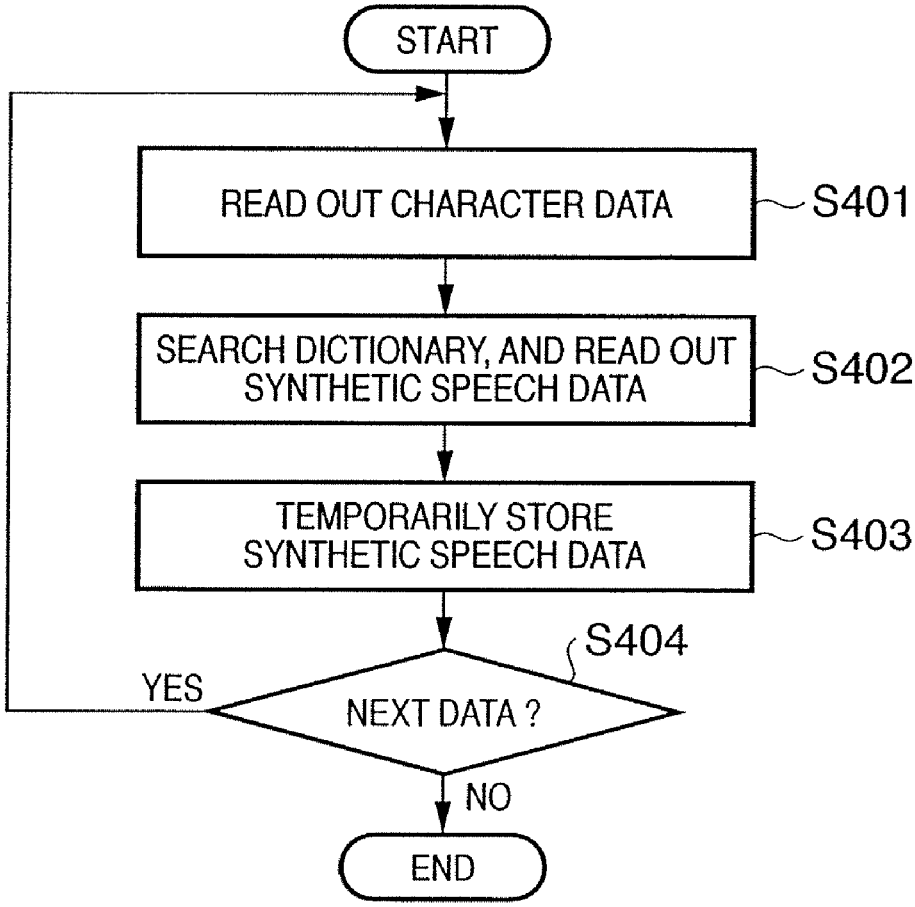
FIG. 4 is a flow chart showing an example of a synthetic speech conversion process for converting text data into synthetic speech data in the first embodiment of the present invention.

FIG. 4 is a flow chart showing an example of a synthetic speech conversion process for converting character data into synthetic speech data. In this embodiment, the contents of various kinds of information such as an e-mail message, news article, and the like received from the network 103 can be read by synthetic speech.

In step S401, the CPU 1 reads out character data of information to be converted into synthetic speech from a memory. The information to be converted is stored in, e.g., the RAM 2 or smart-media card 4*a*. The character data is read out for respective characters, words, or the like. In step S402, the CPU 1 searches the synthetic speech dictionary data stored in the ROM 3 and reads out synthetic speech data corresponding to the character data read out in step S401 from the ROM 3.

In step S403, the CPU 1 temporarily stores the synthetic speech data read out in step S402 in a predetermined area of the RAM 2. The CPU 1 checks in step S404 if character data to be converted still remains. If NO in step S404, the process ends; otherwise, the flow returns to step S501 to repeat the aforementioned process.

With this process, character data such as text data or the like contained in various kinds of information can be converted into synthetic speech data. The converted synthetic speech data is temporarily stored in the RAM 2, and the CPU 1 sequentially reads out the temporarily stored synthetic speech data and outputs it to the D/A converter 10. After that, the D/A converter 10 converts synthetic speech data output from the CPU 1 from a digital signal to an analog signal, which is amplified by the amplifier circuit 11 and is output as actual speech via the loudspeaker 12. In this way, the contents of various kinds of information are read by synthetic speech.

<Music Output Process>

Figure 5:
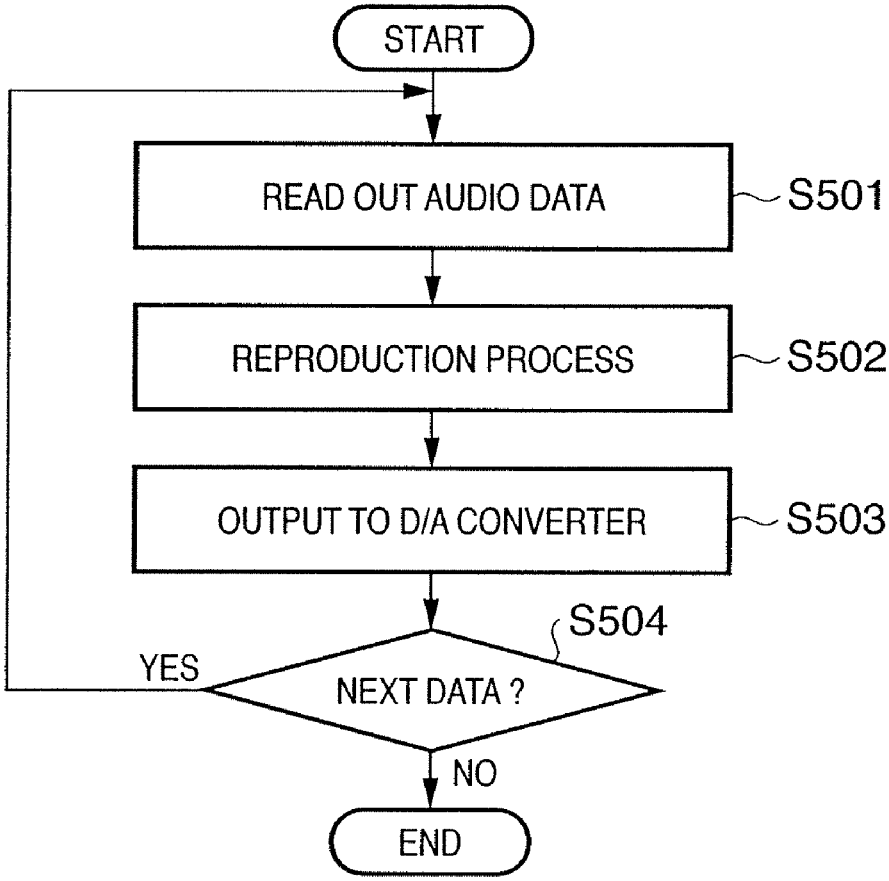
FIG. 5 is a flow chart showing an example of a process executed when the user instructs to output music in the first embodiment of the present invention.

FIG. 5 is a flow chart showing an example of the process when the user instructs to output music. When the user instructs to output music, the CPU 1 launches music playback software stored in the ROM 3 to execute the following process, thus playing back the music.

In step S501, the CPU 1 reads out audio data of music of user's choice from a memory that stores the audio data for respective units. The audio data is stored in, e.g., the smartmedia card 4*a* or the like. In step S502, the CPU 1 executes a reproduction process of the readout audio data. For example, if audio data is compressed data, the CPU 1 decodes it.

In step S503, the CPU 1 outputs the reproduced audio data to the D/A converter 10. After that, the D/A converter 10 converts a digital signal output from the CPU 1 to an analog signal, which is amplified by the amplifier circuit 11 and is output as an actual sound via the loudspeaker 12. The CPU 1 checks in step S504 if the aforementioned processes are complete for all audio data (e.g., for one tune). If NO in step S504, the flow returns to step S501 to repeat these processes. By repeating these processes, the user can listen to music.

<Output of Synthetic Speech During Playback of Music>

A process upon outputting synthetic speech while superposing it on music during playback will be explained below.

The speech output apparatus 101 of this embodiment periodically accesses the server computer 105 to receive information such as a news article or the like and store it in the RAM 2, or to receive an incoming e-mail message and store it in the RAM 3 in response to its arrival. The user is preferably notified of such information as quickly as possible after reception.

Hence, in this embodiment, the contents of the received information can be read by synthetic speech which is superposed on music during playback. However, if the synthetic speech and music are superposed, the user may hardly catch the synthetic speech. In this embodiment, upon outputting synthetic speech, the tone volume of music during playback is reduced to allow the user to easily catch the synthetic speech.

Figure 6:
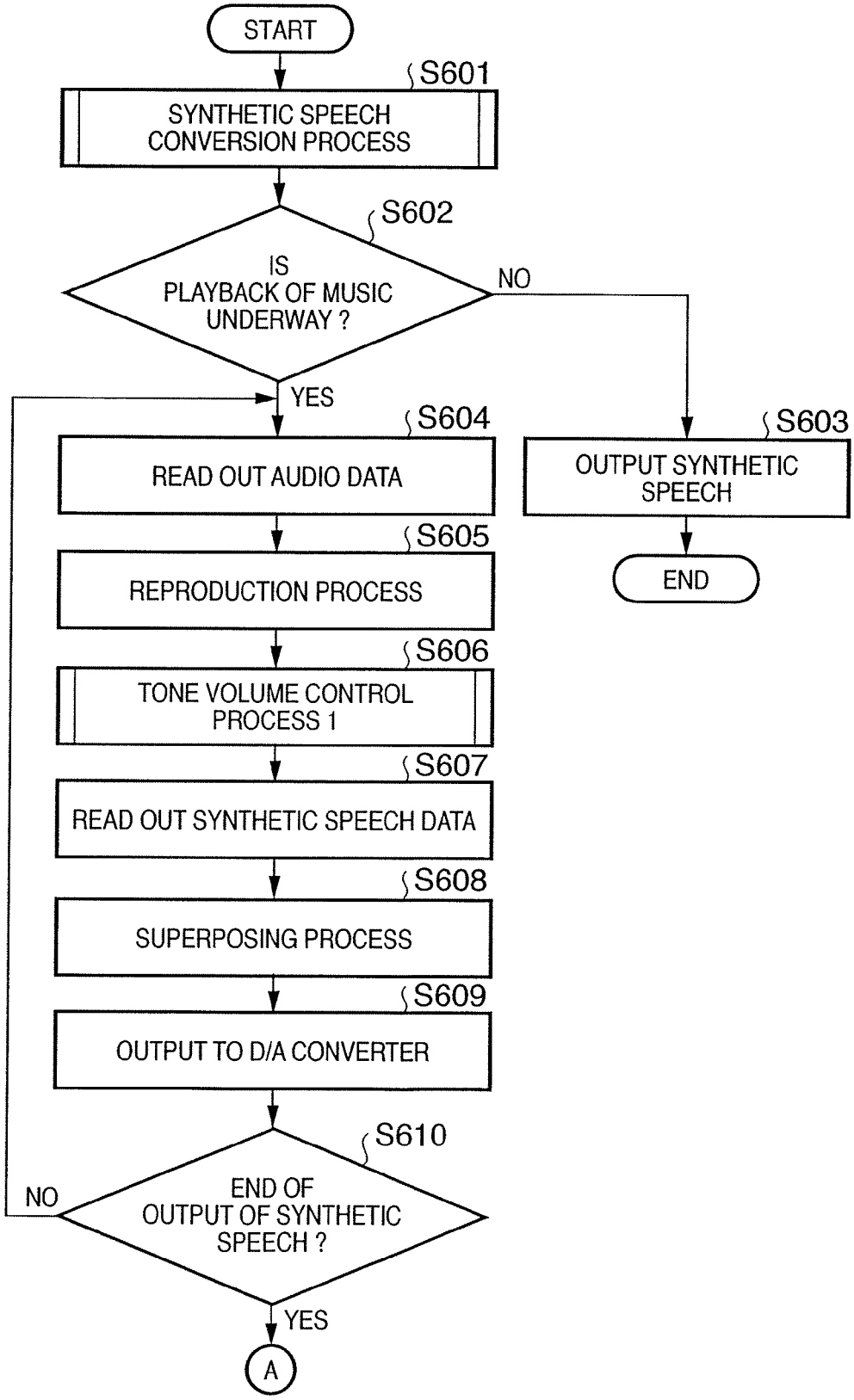
FIG. 6 is a flow chart showing an example of a process executed upon outputting synthetic speech in the first embodiment of the present invention.
Figure 7:
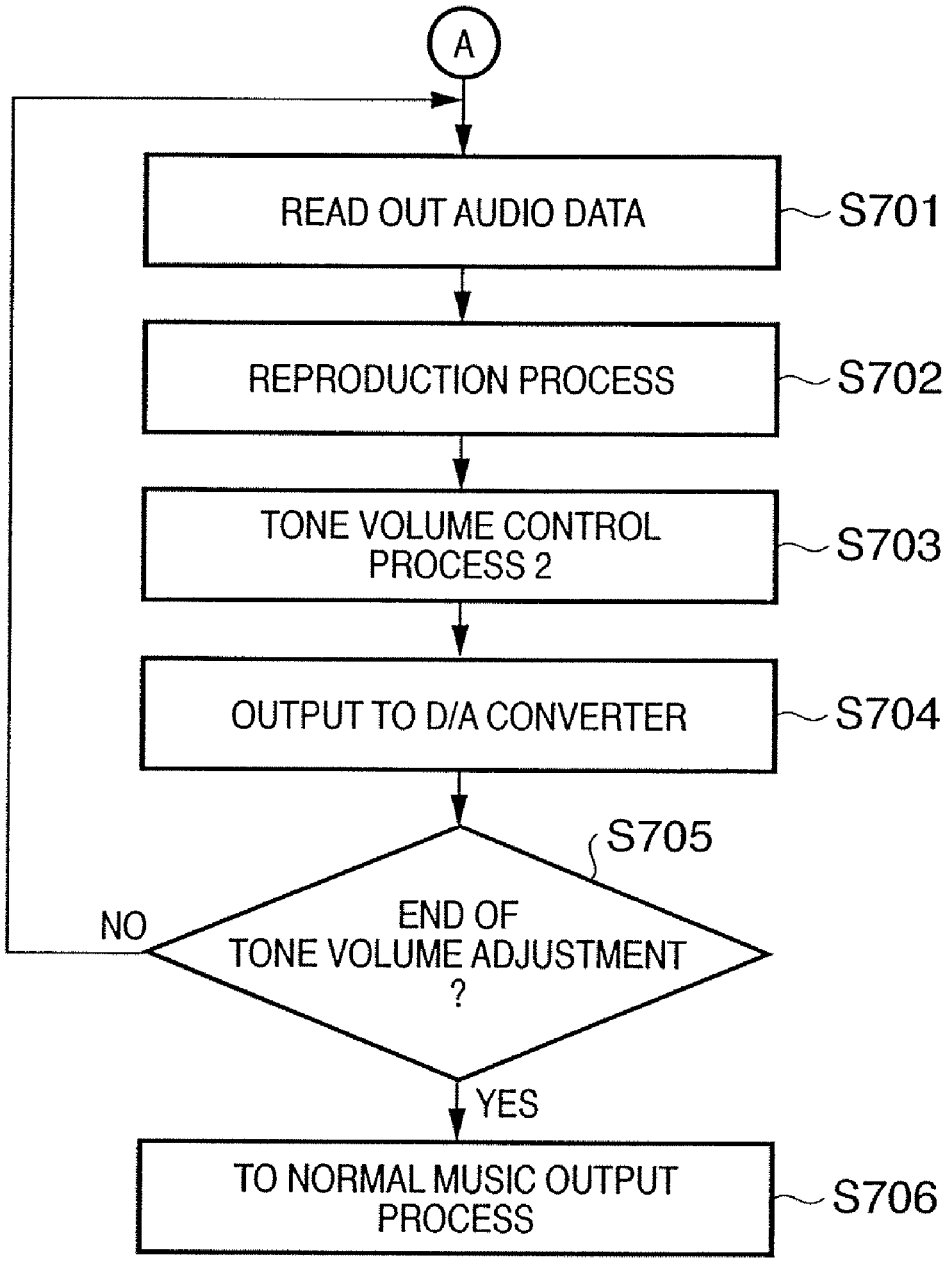
FIG. 7 is a flow chart showing an example of a process executed upon outputting synthetic speech in the first embodiment of the present invention.

FIGS. 6 and 7 are flow charts showing an example of the process upon outputting synthetic speech. This process is executed when the CPU 1 periodically checks if new information from the network 103 is stored in the RAM 3 that stores information, and finds the new information.

In step S601, the CPU 1 executes the synthetic speech conversion process in FIG. 4 for that new information. As a result, synthetic speech information is generated, and is stored in the RAM 2. The CPU 1 checks in step S602 if playback of music is in progress. If NO in step S602, since the synthetic speech need not be superposed on music, the flow advances to step S603 to sequentially output the synthetic speech data to the D/A converter 10, thus outputting synthetic speech. However, if YES in step S602, the flow advances to step S604.

The processes in steps S604 and S605 are the same as those in steps S501 and S502 in FIG. 5. In step S606, the CPU 1 executes tone volume control process 1 to reduce the tone volume of music to be output.

Figure 8:
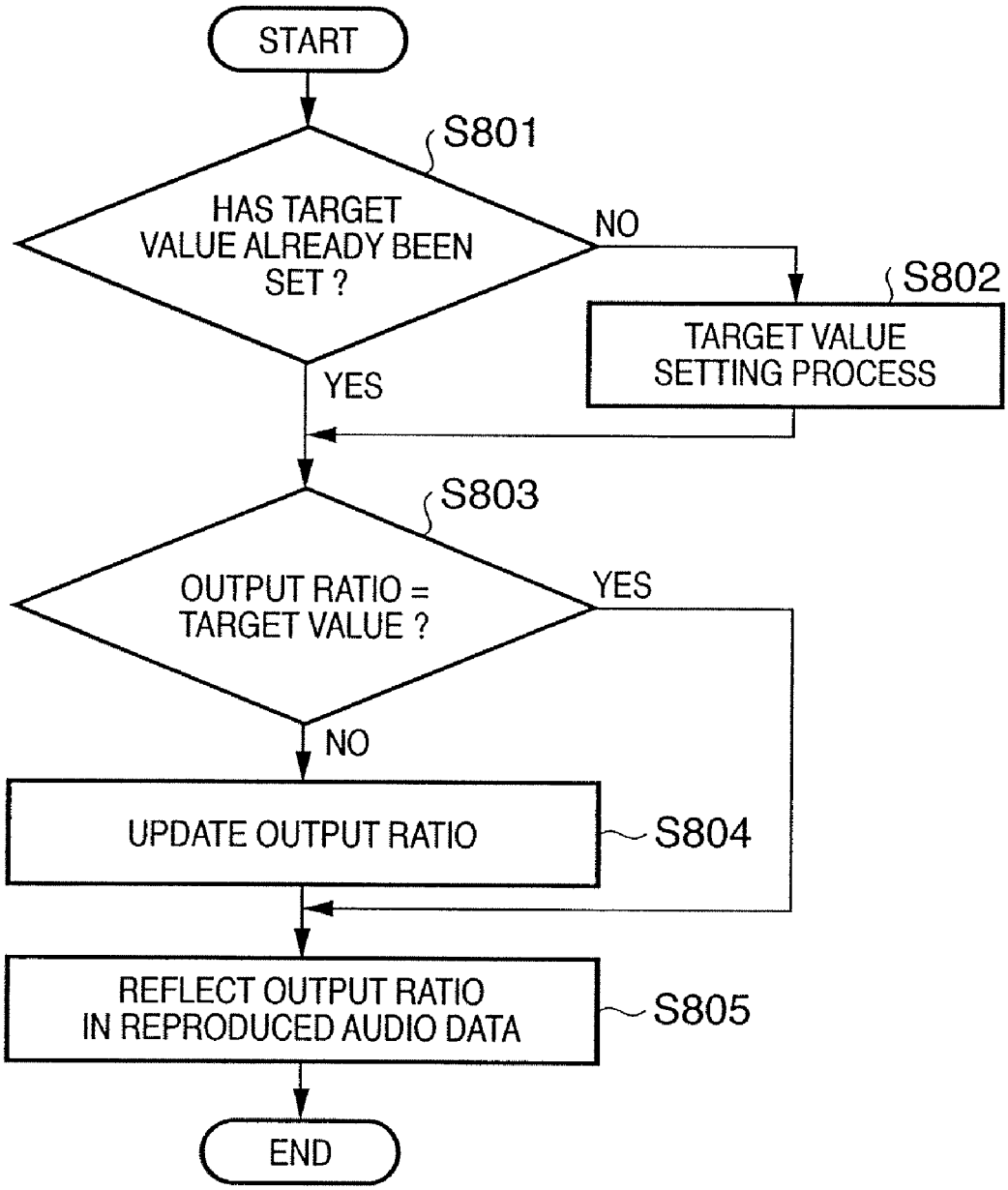
FIG. 8 is a flow chart showing tone volume control process 1 in the first embodiment of the present invention.

FIG. 8 is a flow chart showing tone volume control process 1.

In this embodiment, the value of reproduced audio data is multiplied by a predetermined value to adjust the tone volume. Normally, the predetermined value is 1. However, when the tone volume is to be reduced, audio data is multiplied by, e.g., 0.5(50%). A coefficient (predetermined value) by which the value of the audio data is multiplied will be referred to as an output ratio d ($0<d\leqq 1$, initial value=1) hereinafter. The lower limit value of the output ratio d will be referred to as a target value q ($0<q<1$) hereinafter. The value of the output ratio d gradually decreases, thus gradually reducing the tone volume of music, as will be described later.

The CPU 1 checks in step S801 (FIG. 8) if the target value q has already been set. If NO in step S801, the flow advances to step S802 to set the target value q. The target value q is set when the control enters the loop of steps S604 to S610 in the process in FIG. 6 for the first time, and that target value q is maintained until it is determined in step S610 that synthetic speech is over.

In step S802, the CPU 1 sets the target value q and stores it in, e.g., the RAM 2. The target value q may be a fixed value or may be set by adopting setting methods to be described later.

The CPU 1 checks in step S803 if the output rate d is equal to the target value q. If YES in step S803, since the value of the output ratio d is to be maintained, the flow jumps to step S805. On the other hand, if NO in step S803, the flow advances to step S804.

In step S804, the CPU 1 updates the value of the output ratio d. The output ratio d may be decremented by a predetermined value in proportion to the number of loops of the process. For example, if the output ratio d is decremented by 0.005 per loop of the process, the output ratio d changes like $1 \rightarrow 0.995 \rightarrow 0.990 \rightarrow \ldots \rightarrow$target value q. The output ratio d may be decremented linearly with respect to the number of loops of the process or nonlinearly (along, e.g., a curve). The updated value of the output ratio d is stored in, e.g., the RAM 2.

In step S805, the CPU 1 reflects the output ratio d in the audio data reproduced in step S605 in FIG. 6. For example, the CPU 1 multiplies the digital value of the audio data reproduced in step S605 by the output ratio d, and uses the product as audio data. The amplitude of an analog signal after D/A conversion of the audio data in which the output ratio d is reflected is relatively smaller than audio data which does not undergo such process, thus reducing the tone volume of music.

An example of the method of setting the target value q will be described below.

The target value q can be set based on the average value of powers of music to be output. In this way, an appropriate target value q can be set in accordance with the types of music such as a hard music, slow music, or the like.

The average value of powers of music can be calculated by:

$$Pm(t) = \sum_{\alpha} W^2/\alpha \tag{1}$$

where

Pm(t): the average value of powers for"a" samples of the"t"-th tone to be output W: tone data of each sample Using the average value of powers of music, Q(t) is calculated by:

$$Q(t) = \sum_{t'=t}^{t-(b-1)} Pm(t')/b \tag{2}$$

where b: a constant

Note that Q(t) will be referred to as a power scale of music hereinafter.

The power scale Q(t) in this case means the average value of the most recent"b" Pm(t)s.

The power scale Q(t) can also be calculated by:

$$Q(t)=K\cdot Pm(t)+(1-K)\cdot Q(t-1) \tag{3}$$

where

K: a constant

Then, the target value q can be derived from:

$$q = I \cdot \frac{Ps}{Q(t)} \tag{4}$$

Ps: the average value of powers of synthetic speech

I: a coefficient used to determine the balance between music and synthetic speech q: a target value Note that Ps is a predetermined value as the average value of powers of synthetic speech, and synthetic speech data is generated with reference to this value. The coefficient I may be a fixed value or may be set by the user.

By calculating the target value q in this way, an audio output in which music and synthetic speech are well-balanced in accordance with the type of music can be made. When the target value q is set by this method, the average value Pm(t) of powers of music is always calculated for each output of a tone of music and is stored in the RAM 2 or the like to form a database, and the aforementioned calculations are made to derive the target value q upon executing the process in step S802 in FIG. 8.

The description will revert to the flow chart in FIG. 6.

In step S607, the CPU 1 reads out synthetic speech data stored in the RAM 2. In step S608, the CPU 1 generates audio data by superposing the audio data processed by tone volume control process 1 and the synthetic speech data read out in step S607. In step S609, the CPU 1 outputs the audio data generated in step S608 to the D/A converter 10. Audio data that has been converted into an analog signal is amplified by the amplifier circuit 11, and is output as an actual sound via the loudspeaker 12. In the output sound, the music and synthetic speech are superposed.

The CPU 1 checks in step S610 if all synthetic speech data are output. If NO in step S610, the flow returns to step S604 to repeat the aforementioned sequence. As a result, the tone volume of music output from the loudspeaker 12 is gradually reduced, and the music superposed with synthetic speech is output.

If it is determined in step S610 that all synthetic speech data are output, the flow advances to step S701 in FIG. 7. In steps S701 to S705, processes for playing back music while gradually resuming the tone volume of the music are executed.

The processes in steps S701 and S702 are the same as those in steps S501 and S502 in FIG. 5. In step S703, the CPU 1 executes tone volume control process 2 to resume the tone volume of the music to be output.

Figure 9:
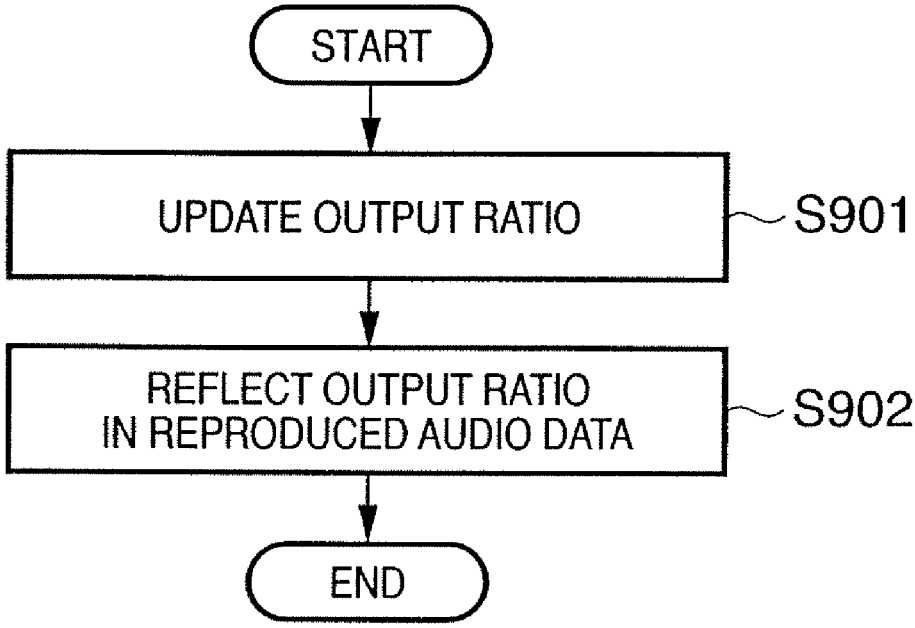
FIG. 9 is a flow chart showing tone volume control process 2 in the first embodiment of the present invention.

FIG. 9 is a flow chart showing tone volume control process 2. The tone volume of music can be immediately returned to the initial value after completion of output of synthetic speech. However, in this embodiment, the tone volume is gradually resumed to reduce user's discomfort.

In step S901, the CPU 1 updates the value of the output ratio d. In step S804 in FIG. 8, the CPU 1 gradually decrements the output ratio d to the target value q. In this process, the CPU 1 gradually increments the output ratio d to the initial value (d=1). In this case, the output ratio d may be incremented linearly with respect to the number of loops of the process or nonlinearly (along, e.g., a curve) as in step S804.

In step S902, the CPU 1 reflects the output ratio d in the audio data reproduced in step S702 in FIG. 7. This process is the same as that in step S805 in FIG. 8. In this manner, tone volume control process 2 is completed once. By repeating the loop of the processes in steps S701 to S705 in FIG. 7, the output ratio d gradually increases to the initial value. As a result, the tone volume of the music to be output gradually increases to an initial value.

Referring back to FIG. 7, the CPU 1 outputs the audio data processed in tone volume control process 2 to the D/A converter 10. The audio data that has been converted into an analog signal is amplified by the amplifier circuit 11, and is output as an actual sound via the loudspeaker 12.

The CPU 1 then checks in step S705 if tone volume adjustment is complete, i.e., if the output ratio d=1. If YES in step S705, the flow advances to step S706 to execute a normal music output process (the process in FIG. 5). If NO in step S705, the flow returns to step S701 to repeat the aforementioned process. As a result, the tone volume of the music to be output via the loudspeaker 12 gradually increases, and the music is finally output with the initial tone volume.

Figure 10:
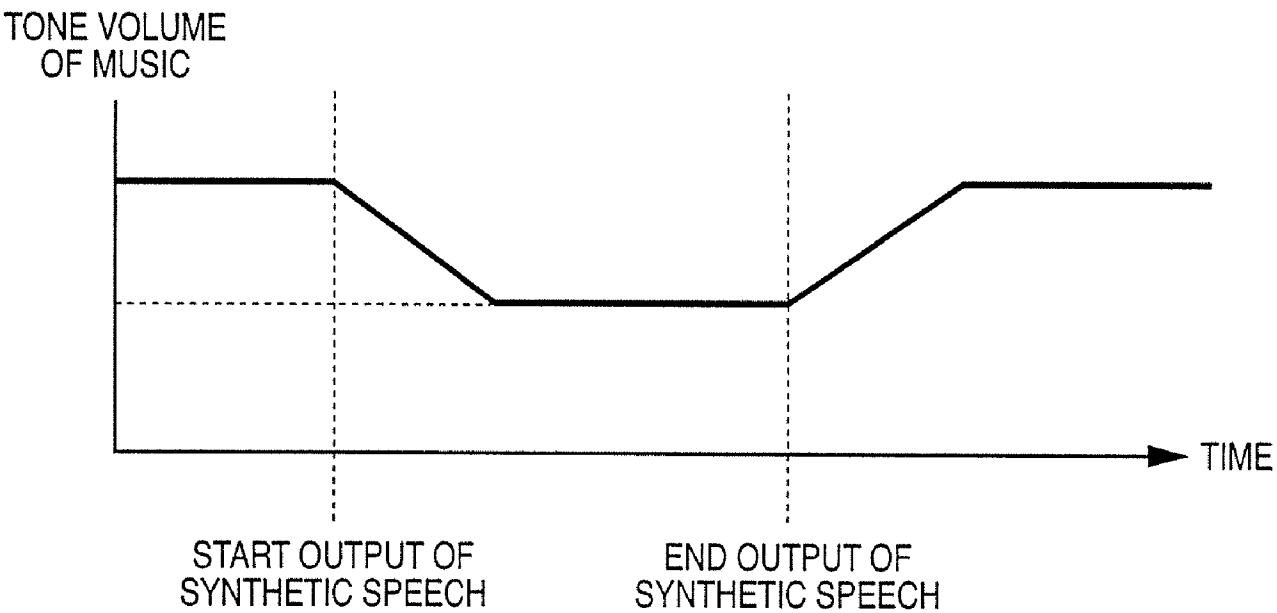
FIG. 10 is a timing chart showing a change in tone volume of a music output from the speech output apparatus 101 in the first embodiment of the present invention.

FIG. 10 is a timing chart showing a change in tone volume of the music to be output from the speech output apparatus 101 by the processes shown in FIGS. 6 and 7. The tone volume of the music gradually decreases simultaneously with the beginning of the output of synthetic speech, and then becomes a constant value. Upon completion of the output of synthetic speech, the tone volume gradually increases and returns to an initial value.

As described above, according to this embodiment, since the tone volume of the music is reduced simultaneously with the beginning of the output of synthetic speech, even when the music and synthetic speech are superposed, the user can reliably catch the synthetic speech. Since the tone volume of the music is gradually reduced, user's discomfort can be reduced. Furthermore, since the tone volume of the music returns to the initial value upon completion of the output of the synthetic speech, user's discomfort can also be reduced from this respect.

In this embodiment, the tone volume of the music is gradually reduced as synthetic speech is output. For example, synthetic speech may begin to be output after the tone volume of the music becomes small (after output ratio d=target value q) in place of starting the output of synthetic speech while the tone volume of the music is changed. In this manner, the user can catch synthetic speech more reliably.

In this embodiment, information such as an e-mail message, news article, or the like sent from the network 103 is received, and is output as synthetic speech, which is superposed on the music. The information to be output as the synthetic speech is not limited to such specific information, and includes various other kinds of information that the user is to be notified. For example, information indicating the state of the speech output apparatus 101 such as the battery remaining amount or the like, information that the speech output apparatus 101 has already stored, and the like may be output.

Modification of First Embodiment

In the above embodiment, upon superposing synthetic speech, the tone volume of the entire music to be output is gradually reduced. Alternatively, the tone volume of only tones, which belong to a predetermined frequency band, of the music to be output may be gradually reduced. For example, the tone volume of only tones, which belong to a frequency band (around 1 to 2 kHz) that includes most frequencies of human voices, may be reduced so as to gradually reduce the tone volume of only a singing voice included in the music. The frequency bands of the singing voice and synthetic speech often overlap, and may make catching synthetic speech hard for the user. In such case, audio data may be input to a band-pass filter to reflect the aforementioned output ratio d in only tones within a predetermined frequency band. In this manner, the sound quality of the music can be relatively maintained.

Based on the same idea, upon setting the target value q using equations (1) to (4) above, the average value Pm of powers of music may be calculated from only powers of tones that belong to a predetermined frequency band in place of those of the entire music. In this case, since the target value q can be calculated based on the average value of powers of only tones that belong to the frequency band which includes most frequencies of human voices, the influence of tone unbalance due to a decrease in tone volume of tones with relatively large powers (e.g., bass tones, drum tones, or the like) can be eliminated.

Furthermore, when the frequency band is taken into consideration, if music includes a male or female singing voice, a different target frequency band may be selected depending on the male or female singing voice. Since the male and female singing voices belong to different frequency bands, the target frequency band can be further narrowed down by discriminating them.

Second Embodiment

The processes to be executed by the speech output apparatus 101 in the second embodiment of the present invention will be described below.

<Process in Speech Output Apparatus>

Figure 11:
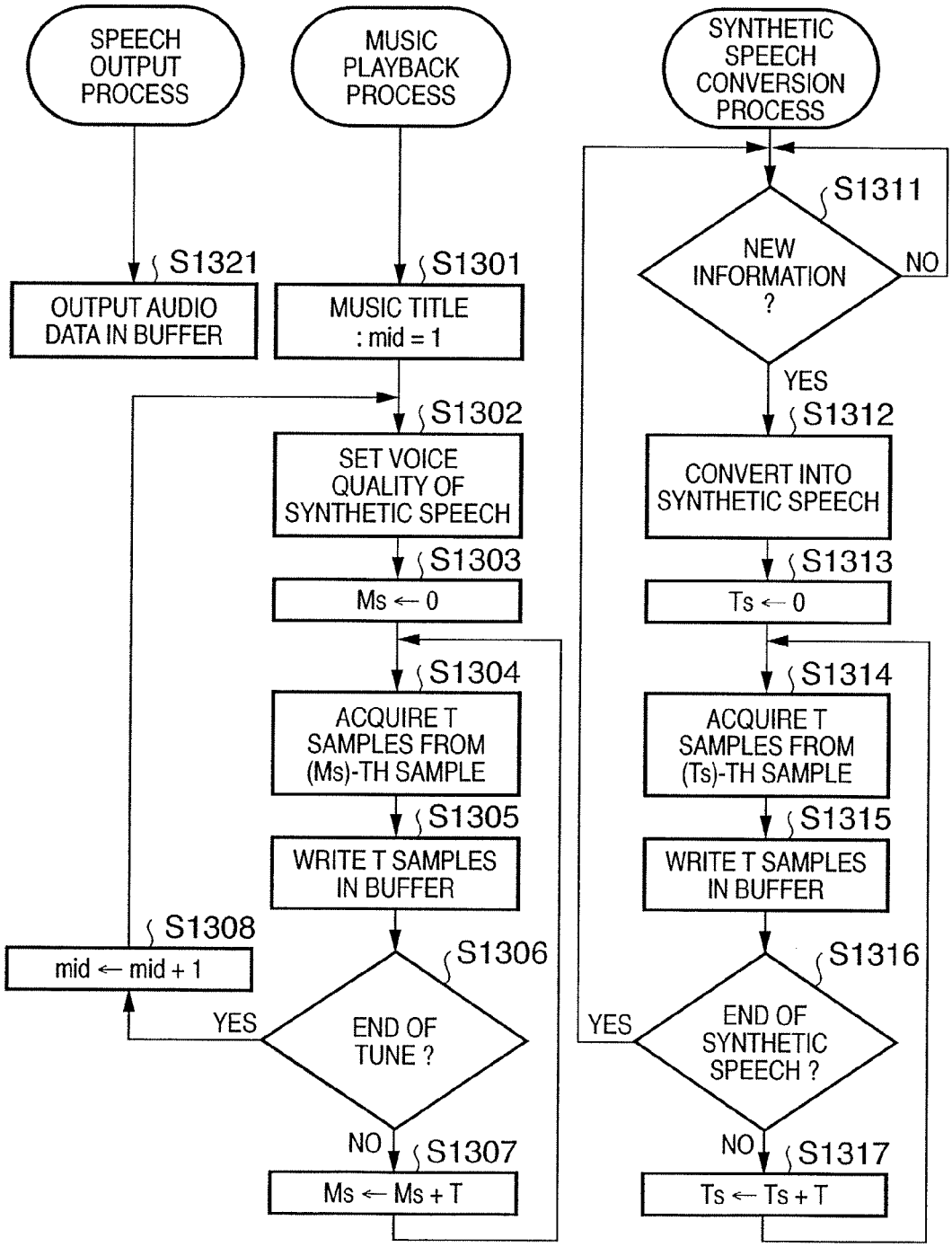
FIG. 11 is a flow chart showing a process executed by the speech output apparatus 101 in the second embodiment of the present invention.

FIG. 11 is a flow chart showing the processes to be executed by the CPU 1. In this embodiment, a speech output process, music playback process, and synthetic speech conversion process shown in FIG. 11 are parallelly executed on the speech output apparatus 101.

The music playback process will be explained first. This process is launched when the user instructs to output music, and is executed until the user instructs to stop the output.

In step S1301, the CPU 1 sets mid as a variable indicating a music title ID to be 1 as an initial value. In this manner, the first tune of a plurality of tunes included in a music file is to be played back.

In step S1302, the CPU 1 sets the voice quality of synthetic speech upon outputting the synthetic speech to be superposed on the tune set in step S1301 during its playback. In this embodiment, the voice quality of synthetic speech is set to have a gender different from that of a vocalist who is singing in the tune to be output. For example, if the vocalist of the tune to be output is a female, synthetic speech is set to have male voice quality; otherwise, synthetic speech is set to have female voice quality.

In this manner, since synthetic speech is superposed on music to have voice quality different from the gender of the vocalist, the user can easily catch the synthetic speech. In this case, whether or not the vocalist of the tune to be output is a female or male must be discriminated. For this purpose, a table that summarizes respective tunes and the genders of vocalists of these tunes may be prepared in advance, as shown in FIG. 16, and may be looked up upon setting the voice quality of synthetic speech.

On the other hand, the voice quality of synthetic speech may be set for each music title in place of the table shown in FIG. 16. Furthermore, synthetic speech may be output to have not only voice quality depending on the gender but also one of a plurality of types of voice quality for a male or female. FIG. 17 shows an example of a table that summarizes tunes and voice quality of synthetic speech corresponding to each tune. According to this table, when the music title ID is 1, synthetic speech is set to have male voice quality with type 1 (male 1). When the music title ID is 2, synthetic speech is set to have female voice quality with type 3 (female 3).

In step S1303, the CPU 1 sets a variable Ms indicating the sample position of audio data of music to be played back to be 0. In this manner, the audio data is read out from its head. In step S1304, the CPU 1 acquires samples to be played back per process (e.g., T samples) from the (Ms)-th sample. If the audio data is compressed, the CPU 1 decodes it, and writes the acquired audio data for T samples in a buffer (S1305). The buffer is, e.g., an internal memory of the RAM 2 or CPU 1.

The CPU 1 checks in step S1306 if the tune is over. If YES in step S1306, the flow advances to step S1308 to increment the variable mid by one, and the flow returns to step S1302. In this way, the next tune is played back. On the other hand, if NO in step S1306, the flow advances to step S1307 to increment the variable Ms by T, and the flow then returns to step S1304 to play back the next sample.

By repeating the aforementioned processes, the buffer can store audio data.

The synthetic speech conversion process will be explained below.

The speech output apparatus 101 of this embodiment periodically accesses the server computer 105 to receive information such as a news article or the like and store it in the RAM 2, or to receive an incoming e-mail message and store it in the RAM 3 in response to its arrival. If new information has arrived, its contents are read by synthetic speech.

The CPU 1 checks in step S1311 if new information is received. If YES in step S1311, the flow advances to step S1312 to convert the contents of that information into synthetic speech. More specifically, character data such as text data or the like contained in that information are converted into synthetic speech data.

In the synthetic speech conversion in step S1312, synthetic speech data is generated to have the voice quality set in step S1302. That is, if the vocalist of the music to be output is a female, synthetic speech data with male voice quality is generated; otherwise, synthetic speech data with female voice quality is generated. The generated synthetic speech data is temporarily saved.

In step S1313, the CPU 1 sets a variable Ts indicating the sample position of synthetic speech data to be 0. In this manner, the synthetic speech data generated in step S1312 are read out from the head. In step S1314, the CPU 1 acquires samples to be output per process (e.g., T samples) from the (Ts)-sample. The CPU 1 writes the acquired synthetic speech data for T samples in the buffer (S1315). At this time, the synthetic speech data is superposed on the audio data.

The CPU 1 checks in step S1316 if all synthetic speech data are written in the buffer. If YES in step S1316, the flow returns to step S1311. If data to be converted still remains, the flow advances to step S1317 to increment the variable Ts by T, and the flow then returns to step S1314 to write the next sample in the buffer.

The speech output process will be described next.

In step S1321, the CPU 1 outputs the audio data and synthetic speech data stored in the buffer to the D/A converter 10. After that, the D/A converter 10 converts a digital signal output from the CPU 1 to an analog signal, which is amplified by the amplifier circuit 11 and is output as an actual sound via the loudspeaker 12. This process is repeated as long as the buffer stores data.

In this manner, according to this embodiment, the contents of information such as a news article, e-mail message, or the like received from the network 103 can be output as synthetic speech, which is superposed on the music. In this case, since the voice quality of synthetic speech is set in accordance with the music to be output, the user can easily catch the synthetic speech.

In this embodiment, information such as an e-mail message, news article, or the like sent from the network 103 is received, and is output as synthetic speech, which is superposed on the music. The information to be output as the synthetic speech is not limited to such specific information, and includes various other kinds of information that the user is to be notified. For example, information indicating the state of the speech output apparatus 101 such as the battery remaining amount or the like, information that the speech output apparatus 101 has already stored, and the like may be output.

<Another Example of Music Playback Process>

Figure 12:
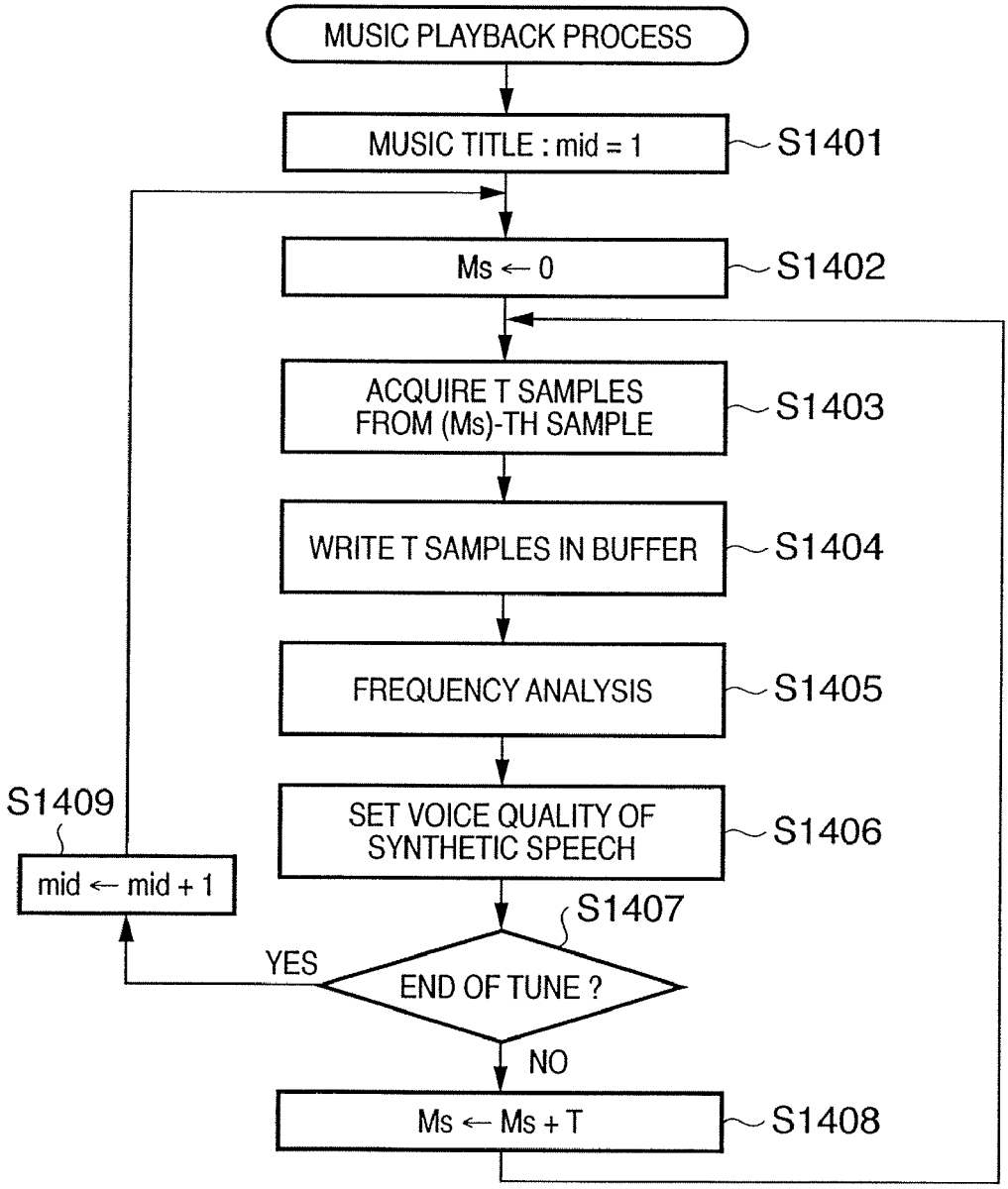
FIG. 12 is a flow chart showing another example of a speech reproduction process in the second embodiment of the present invention.

FIG. 12 is a flow chart showing another example of the music playback process that has been explained with reference to FIG. 11. In the example in FIG. 11, the gender of the voice quality of synthetic speech is set to be different from that of the vocalist of music. In this example, the voice quality is set by setting the fundamental frequency (also called a fundamental period or pitch) of synthetic speech based on the frequency of the music to be output.

In step S1401, the CPU 1 sets mid as a variable indicating the music title ID to be 1 as an initial value. In step S1402, the CPU 1 sets the variable Ms indicating the sample position of audio data of music to be played back to be 0. The CPU 1 acquires samples to be played back per process (e.g., T samples) from the (Ms)-th sample in step S1403, and writes them in the buffer after it decodes them as needed (S1404).

Figure 14:
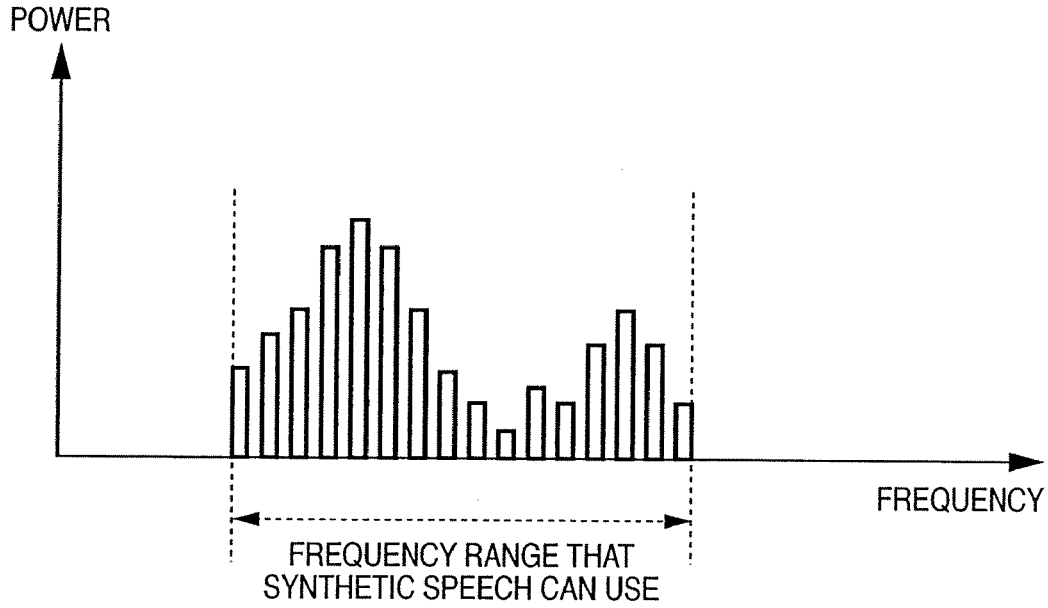
FIG. 14 shows an example of a graph showing the relationship between the power value and frequency of music in the second embodiment of the present invention.

In step S1405, the CPU 1 executes frequency analysis of the music to be output. In this case, the CPU 1 executes frequency analysis of previous audio data for a predetermined number of samples that include T samples, which are written in the buffer in step S1404, by Fast Fourier Transformation. As a result, the power values of frequency components within the fundamental frequency range that can be used as synthetic speech are calculated. FIG. 14 is a graph showing the relationship between the calculated power values and frequencies. The fundamental frequency range that can be used as synthetic speech corresponds to, e.g., that of human voices.

Figure 15:
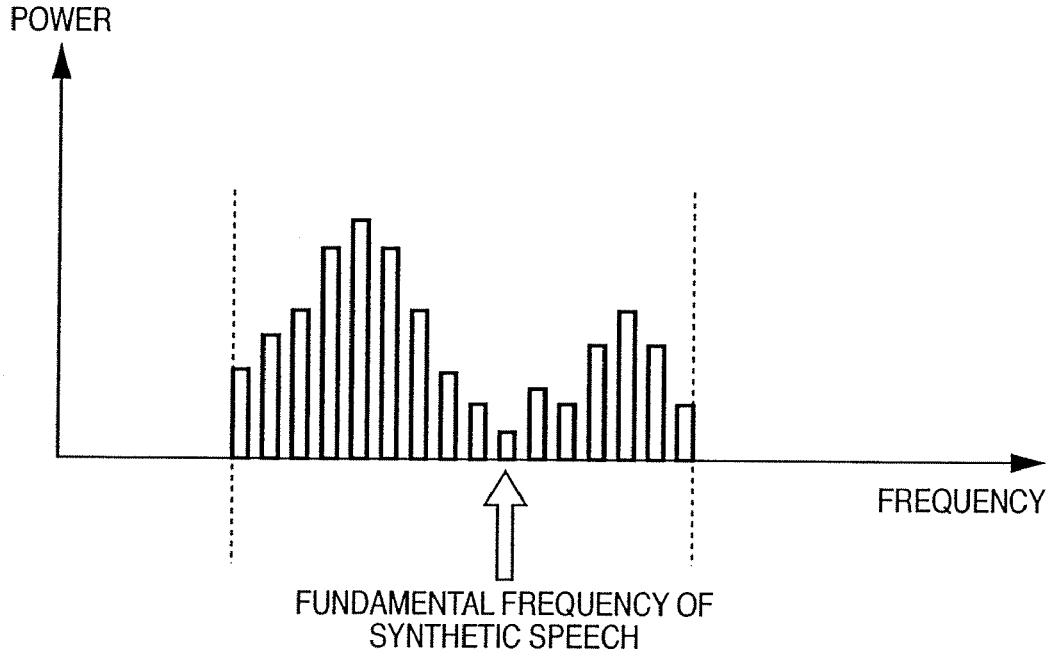
FIG. 15 shows an example of a graph showing the relationship between the power value and frequency of music in the second embodiment of the present invention.

In step S1406, the CPU 1 sets the voice quality of synthetic speech to be superposed on the music in accordance with the frequency analysis result in step S1405. In this case, the CPU 1 selects the frequency with the smallest power from the frequency components of the music to be output, and sets it as the fundamental frequency of synthetic speech. In the example of the graph in FIG. 14, a frequency indicated by an arrow in the graph of FIG. 15 is selected as the fundamental frequency of synthetic speech.

In step S1312 of the synthetic speech conversion process that has been explained with reference to FIG. 11, synthetic speech data is generated based on the fundamental frequency set in this process.

The CPU 1 checks in step S1407 if the tune is over. If YES in step S1407, the flow advances to step S1409 to increment the variable mid by one, and the flow returns to step S1402. On the other hand, if NO in step S1407, the flow advances to step S1408 to increment the variable Ms by T, and the flow then returns to step S1403 to play back the next sample.

In this manner, according to this example, since the voice quality of synthetic speech is set by selecting a frequency with small power in the music to be output as the fundamental frequency of synthetic speech, the synthetic speech is output to have voice quality in the frequency band, which is not used much in the music, and the user can easily catch the synthetic speech.

<Still Another Example of Music Playback Process>

Figure 13:
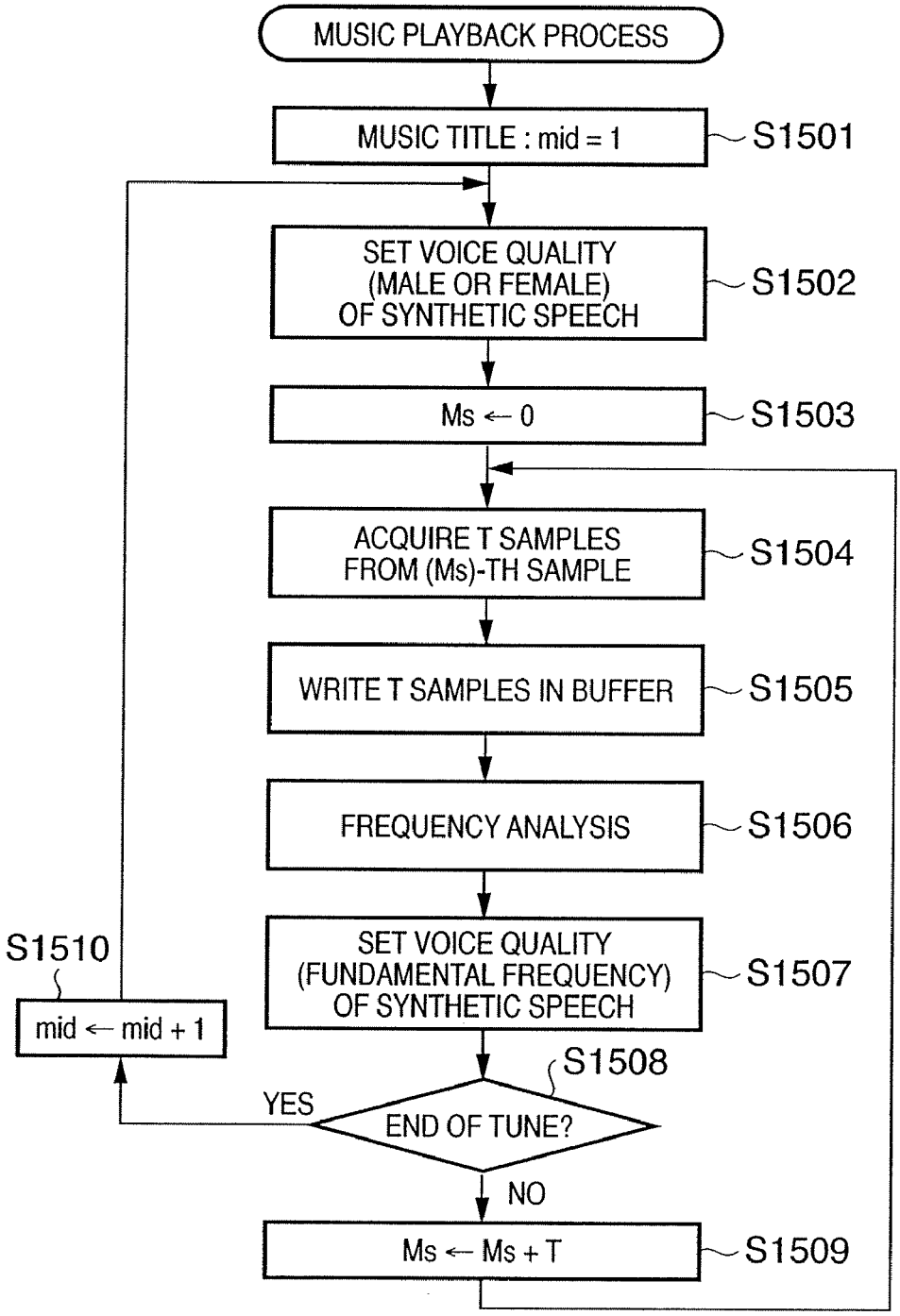
FIG. 13 is a flow chart showing still another example of a speech reproduction process in the second embodiment of the present invention.

FIG. 13 is a flow chart showing still another example of the music playback process that has been explained with reference to FIG. 11. In this embodiment, the voice quality of synthetic speech is set to have a gender different from that of the vocalist of music, as in FIG. 11, and the fundamental frequency of the synthetic speech is set based on the frequency of the music to be output.

In step S1501, the CPU 1 sets mid as a variable indicating the music title ID to be 1 as an initial value. In step S1502, the CPU 1 sets the voice quality of synthetic speech upon outputting the synthetic speech to be superposed on the tune set in step S1501 during its playback. As in step S1302 in FIG. 11, the voice quality is set to have a gender different from that of the vocalist of the music.

In step S1503, the CPU 1 sets the variable Ms indicating the sample position of audio data of music to be played back to be 0. The CPU 1 acquires samples to be played back per process (e.g., T samples) from the (Ms)-th sample in step S1504, and writes them in the buffer after it decodes them as needed (S1505).

In step S1506, the CPU 1 executes frequency analysis of the music to be output. This process is the same as that in step S1405 in FIG. 12. Note that the fundamental frequency range corresponding to the gender set in step S1502 can be set as the fundamental frequency range that can be used as synthetic speech. For example, if the voice quality is set to be a female in step S1502, a range from 150 to 500 Hz is approximately set; if the voice quality is set to be a male, a range from 70 to 200 Hz is approximately set.

In step S1507, the CPU 1 sets the voice quality of synthetic speech to be superposed on the music in accordance with the frequency analysis result in step S1506. In this case, the CPU 1 selects a frequency with smallest power from the frequency components of the music to be output, and sets it as the fundamental frequency of synthetic speech. In step S1312 of the synthetic speech conversion process that has been explained with reference to FIG. 11, synthetic speech data is generated based on the gender set in step S1502, and the fundamental frequency set in this process.

The CPU 1 checks in step S1508 if the tune is over. If YES in step S1508, the flow advances to step S1510 to increment the variable mid by one, and the flow returns to step S1502. On the other hand, if NO in step S1508, the flow advances to step S1509 to increment the variable Ms by T, and the flow then returns to step S1504 to play back the next sample.

As described above, according to this example, since synthetic speech is output to have voice quality of a gender different from the vocalist of the music to be output, and the voice quality of the synthetic speech is set by selecting the frequency with the small power of the music to be output as the fundamental frequency of the synthetic speech, the user can easily catch the synthetic speech.

<Operation to Speech Output Apparatus>

Figure 18:
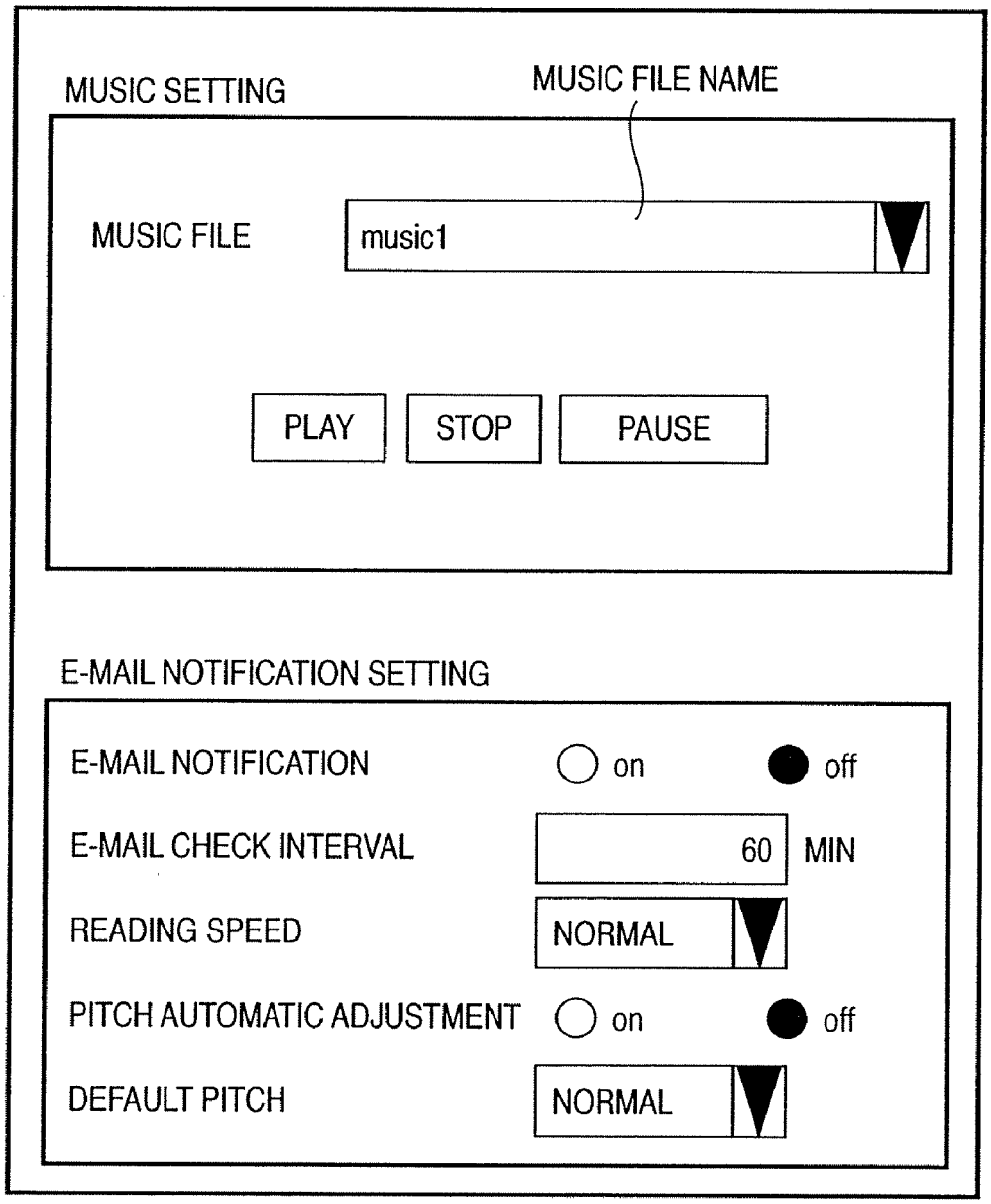
FIG. 18 shows an example of an operation selection window displayed on the display 9 in the second embodiment of the present invention.

FIG. 18 shows an example of the operation selection window displayed on the display 9. The user can issue various instructions in accordance with respective display areas by operating the aforementioned operation switch 6. The speech output apparatus 101 functions in accordance with user's operations.

Figure 19:
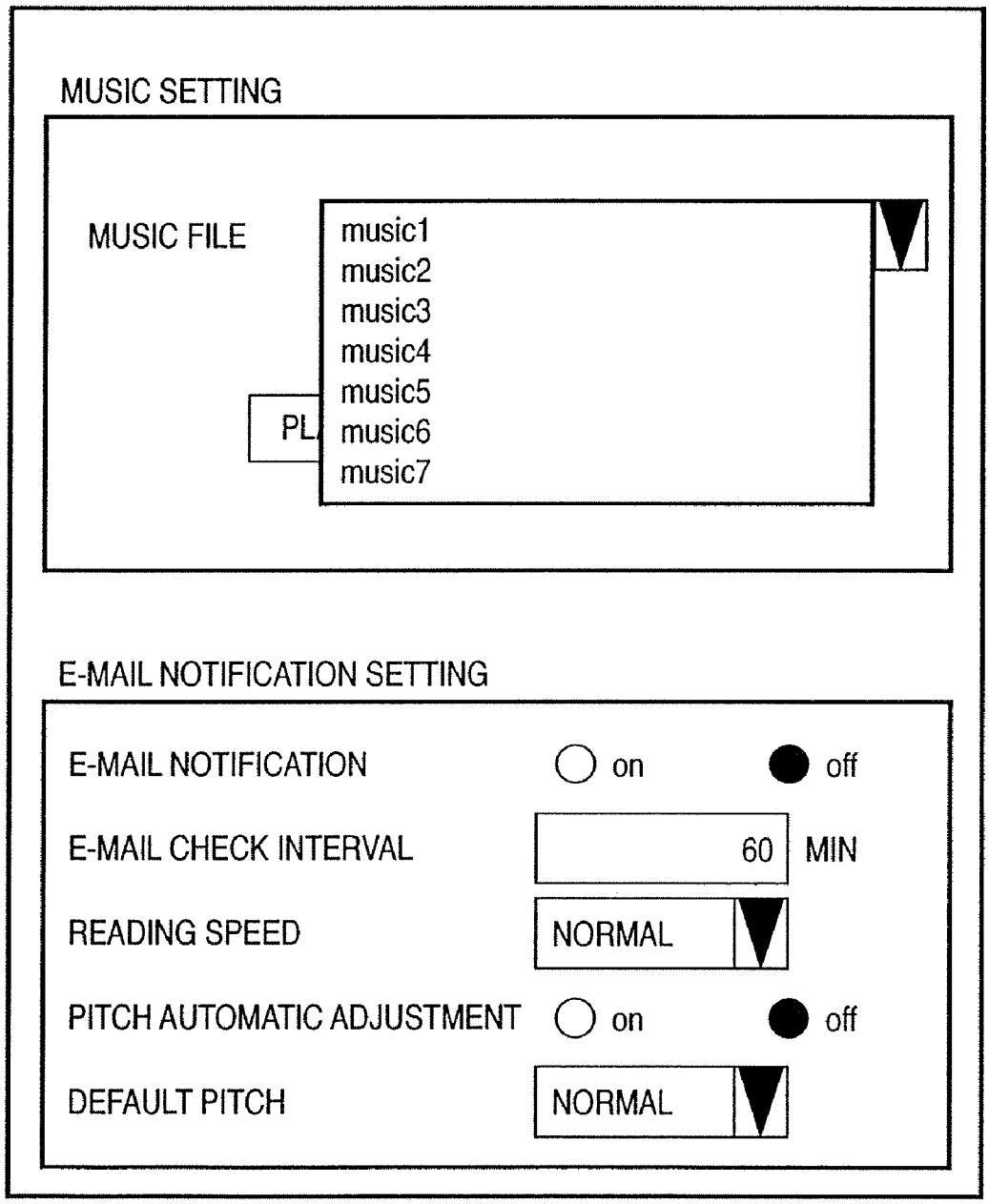
FIG. 19 shows an example of an operation selection window displayed on the display 9 in the second embodiment of the present invention.
Figure 20:
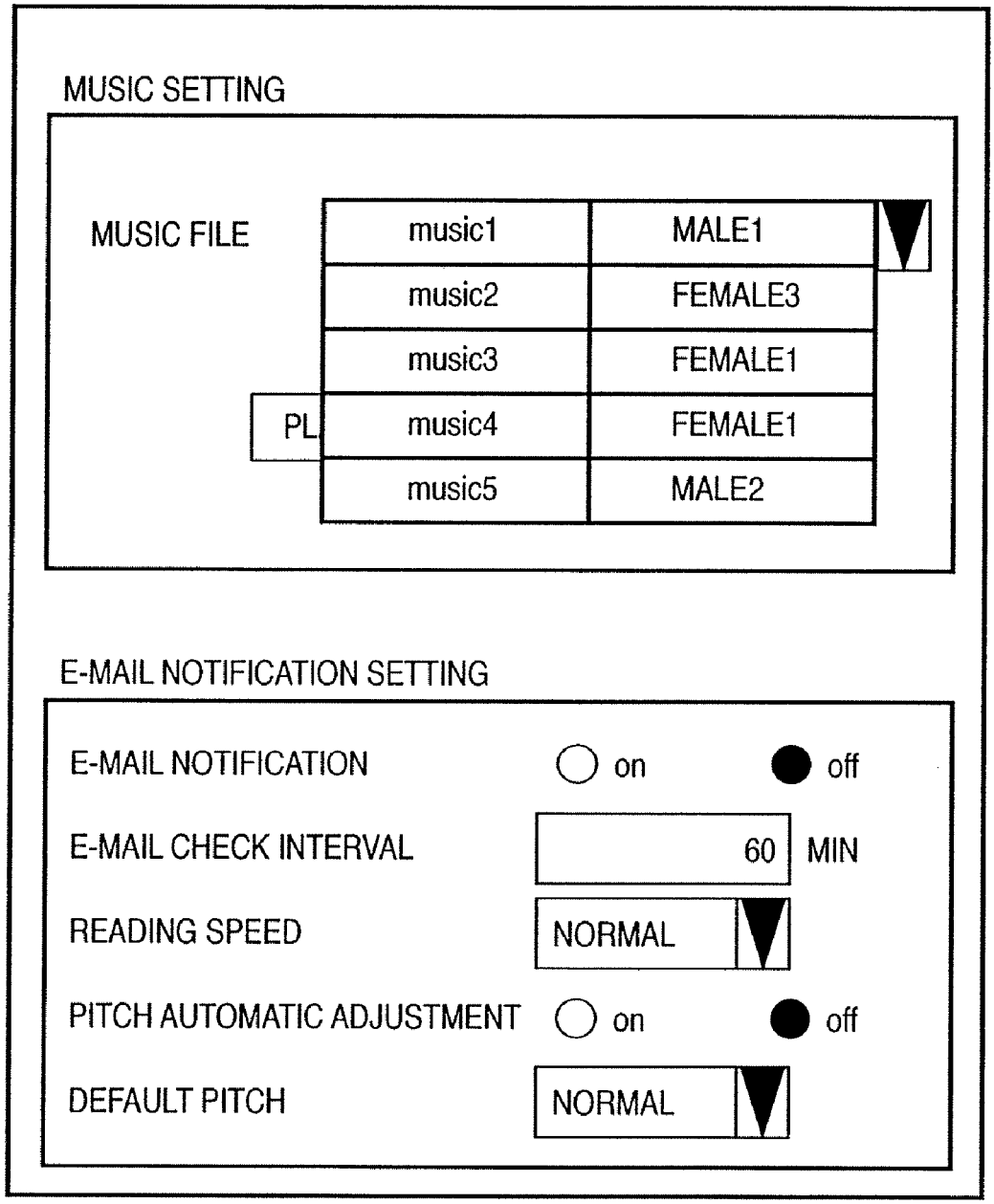
FIG. 20 shows an example of an operation selection window displayed on the display 9 in the second embodiment of the present invention.

In FIG. 18, on a"music setting" region, buttons used to display music files in a list and to play, stop, and pause music playback are displayed. When the black triangular button of"music file" is displayed, music files are displayed in a list, as shown in FIG. 19. In this case, the voice quality of synthetic speech can be set for each file, as shown in FIG. 20. In FIG. 20, the type of voice quality of synthetic speech can be input to a field on the right side of each music file name, and the user can input the type of voice quality of synthetic speech such as male 1, female 3, or the like. The information input on this area is reflected in, e.g., the table that has been explained with reference to FIG. 17.

On the other hand, on an"e-mail notification setting" area, radio buttons (on, off) used to select if reception of an e-mail message is automatically notified using synthetic speech, a field used to input the e-mail reception check interval (sec), an e-mail reading speech select box, radio buttons (on, off) used to select if the pitch (fundamental frequency) of synthetic speech is automatically adjusted, and a default pitch select box, are displayed.

When the user selects automatic adjustment of the pitch of synthetic speech (on), the processes in steps S1405 and S1406 in FIG. 12 or in steps S1506 and S1507 in FIG. 13 are executed, and the fundamental frequency of synthetic speech is set in correspondence with the music to be output. By contrast, when the user does not select automatic adjustment of the pitch of synthetic speech (off), frequency analysis in step S1405 in FIG. 12 or step S1506 in FIG. 13 is skipped, and a default pitch (fundamental frequency) is set.

Third Embodiment

The third embodiment of the present invention will be described below.

<Operation to Speech Output Apparatus>

Figure 21:
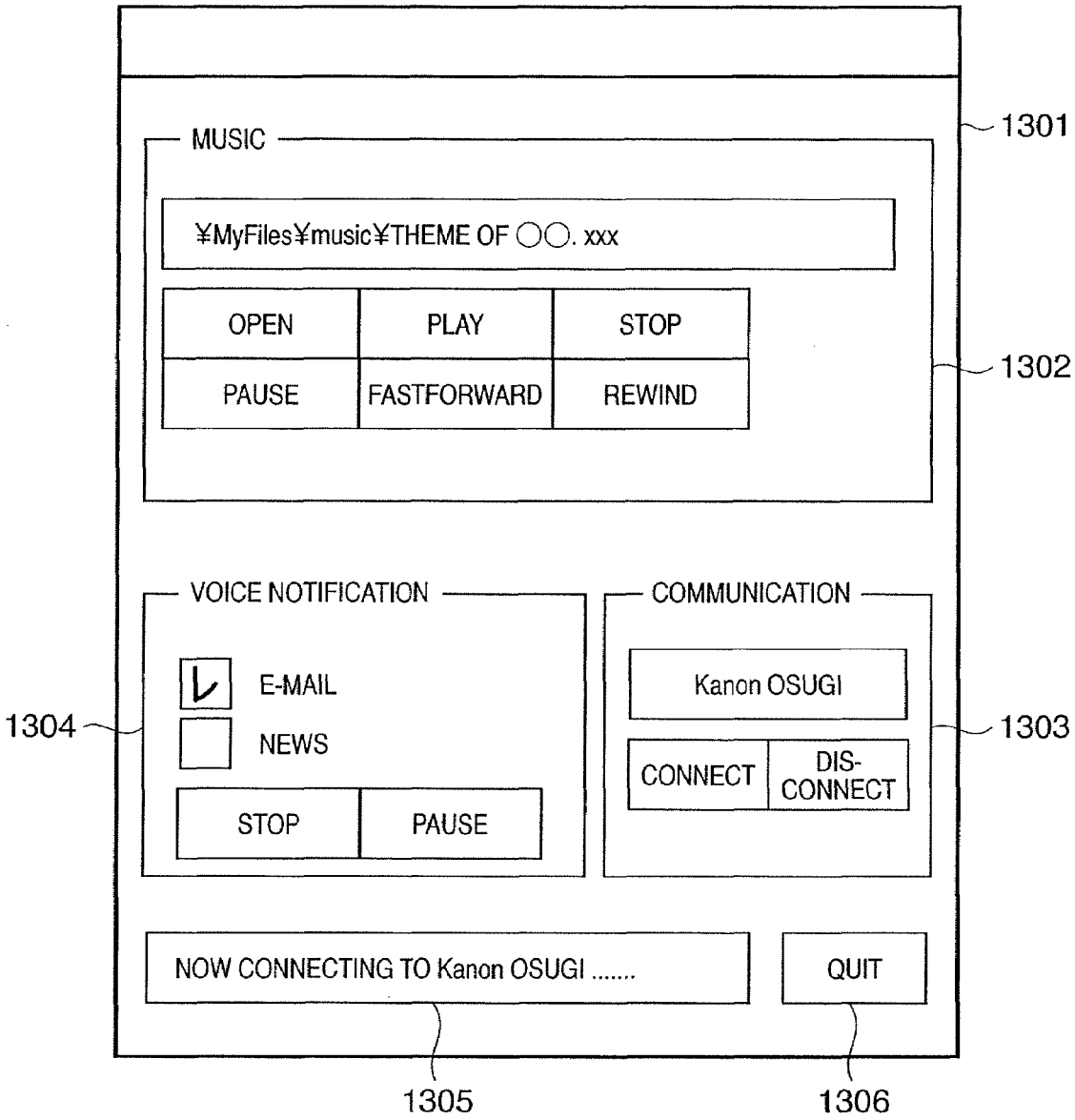
FIG. 21 shows an example of an operation selection window displayed on the display 9 in the third embodiment of the present invention.

FIG. 21 shows an example of an operation selection window displayed on the display 9 in the first embodiment of the present invention. On an application window 1301, displays used to make various operations are made. The user can issue various instructions in accordance with respective display areas by operating the aforementioned operation switch 6.

On a music playback operation area 1302, an input field for designating a music data file to be played back, and buttons used to play, stop, pause, fastforward, and rewind music are displayed.

On a communication setup operation area 1303, an input field for designating a destination of connection, and buttons used to instruct to establish and release connection are displayed.

An operation area 1304 is used to set if information received from the network 103 is to be converted into synthetic speech to be output. The operation area 1304 includes check boxes for e-mail and news. Upon receiving information corresponding to the checked check box, that information can be converted into synthetic speech to be output.

In FIG. 21, since the e-mail check box is checked, when an e-mail message is received, its contents are converted into synthetic speech to be output. Also, on the operation area 1304, buttons used to stop or pause the output of synthetic speech are displayed.

A status display field 1305 displays information indicating the current status of the speech output apparatus 101, and a quit button 1306 is used to instruct to quit this application.

The user can listen to his or her favorite music or hear synthetic speech by reading the contents of a news or e-mail message received from the network 103 via the base station 104.

<Process in Speech Output Apparatus>

The processes to be executed by the speech output apparatus 101 will be described below.

Figure 22:
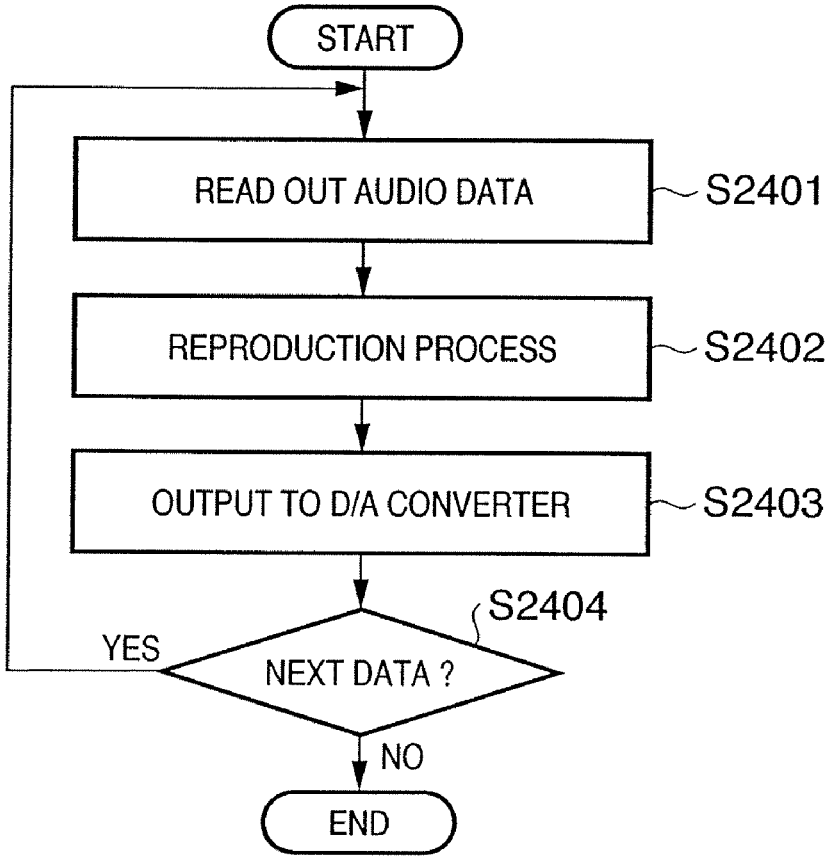
FIG. 22 is a flow chart showing an example of a process executed when the user instructs to output music in the third embodiment of the present invention.

FIG. 22 is a flow chart showing an example of the process when the user instructs to output music. When the user instructs to output music, the CPU 1 launches music playback software stored in the ROM 3 to execute the following process.

In step S2401, the CPU 1 reads out audio data of music of user's choice from a memory that stores the audio data for respective units. The audio data is stored in, e.g., the smart-media card 4*a* or the like.

In step S2402, the CPU 1 executes a reproduction process of the readout audio data. For example, if audio data is compressed data, the CPU 1 decodes it.

In step S2403, the CPU 1 outputs the reproduced audio data to the D/A converter 10. After that, the D/A converter 10 converts a digital signal output from the CPU 1 to an analog signal, which is amplified by the amplifier circuit 11 and is output as an actual sound via the loudspeaker 12. The CPU 1 checks in step S2404 if the aforementioned processes are complete for all audio data (e.g., for one tune). If NO in step S2404, the flow returns to step S2401 to repeat these processes. By repeating these processes, the user can listen to a piece of music.

Figure 23:
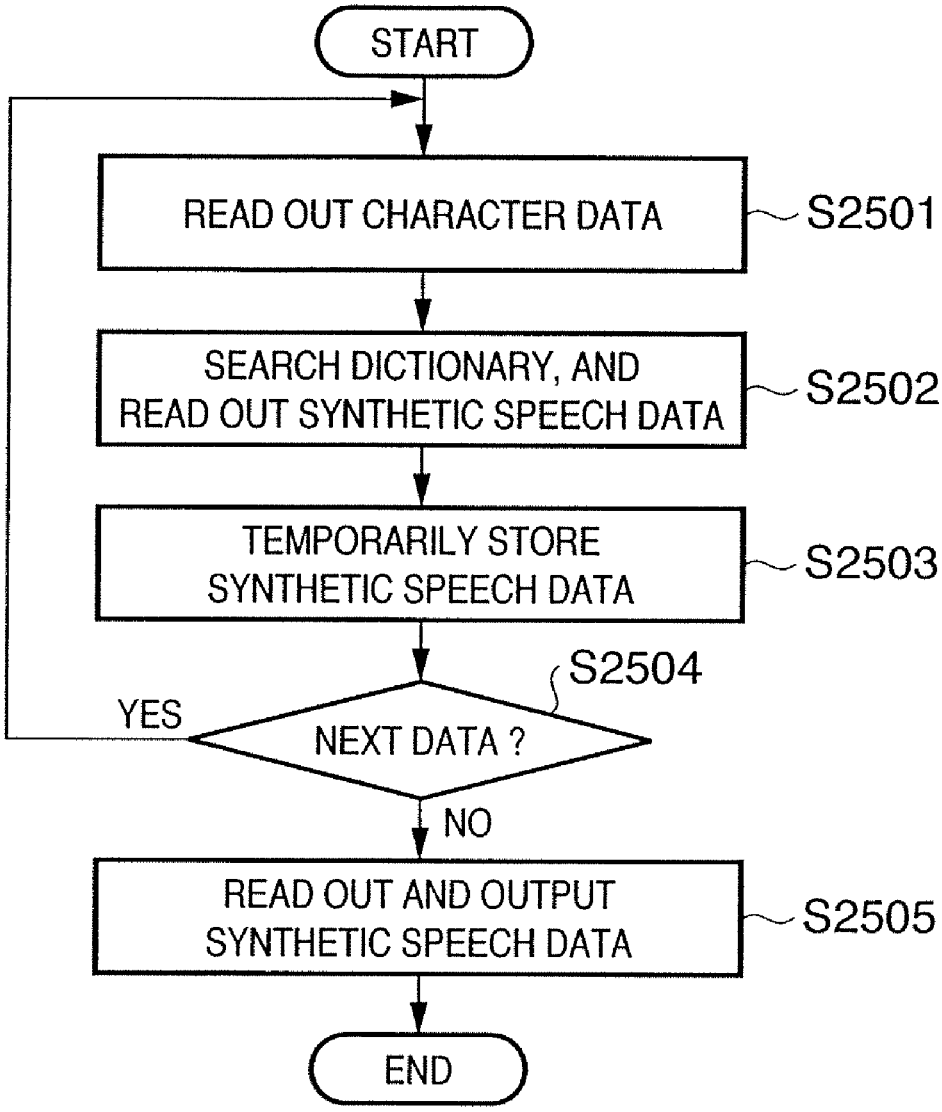
FIG. 23 is a flow chart showing an example of a synthetic speech process for converting text data into synthetic speech data, and outputting the synthetic speech data in the third embodiment of the present invention.

FIG. 23 is a flow chart showing an example of a synthetic speech process for converting character data into synthetic speech data to be output.

In step S2501, the CPU 1 reds out character data of information to be converted into synthetic speech from a memory. The information to be converted is stored in, e.g., the RAM 2 or smart-media card 4*a*. The character data is read out for respective characters, words, or the like. In step S2502, the CPU 1 searches the synthetic speech dictionary data stored in the ROM 3 and reads out synthetic speech data corresponding to the character data read out in step S2501 from the ROM 3.

In step S2503, the CPU 1 temporarily stores the synthetic speech data read out in step S2502 in a predetermined area of the RAM 2. The CPU 1 checks in step S2504 if character data to be converted still remains. If NO in step S2504, the flow advances to step S2505; otherwise, the flow returns to step S2401 to repeat the aforementioned process. In step S2505, the CPU 1 sequentially reads out the synthetic speech data temporarily stored in the RAM 2 and outputs them to the D/A converter 10. After that, the D/A converter 10 converts synthetic speech data output from the CPU 1 from a digital signal to an analog signal, which is amplified by the amplifier circuit 11 and is output as actual speech via the loudspeaker 12.

In this manner, the contents of various kinds of information are read by synthetic speech. In this embodiment, the synthetic speech data is temporarily stored in step S2503. Alternatively, after character data is converted into synthetic speech data, it can be directly output.

<Output Timing Control Process of Synthetic Speech>

The output timing control of synthetic speech will be described below.

The speech output apparatus 101 of this embodiment periodically accesses the server computer 105 to receive information such as a news article or the like and store it in the RAM 2, or to receive an incoming e-mail message and store it in the RAM 3 in response to its arrival. The user is preferably notified of such information as quickly as possible after reception.

However, when the contents of the received information are read by synthetic speech, and the synthetic speech is superposed on the music during its playback, the user may hardly catch the synthetic speech. In this embodiment, upon outputting the received information as synthetic speech, the following process is executed to control its output timing.

Figure 24:
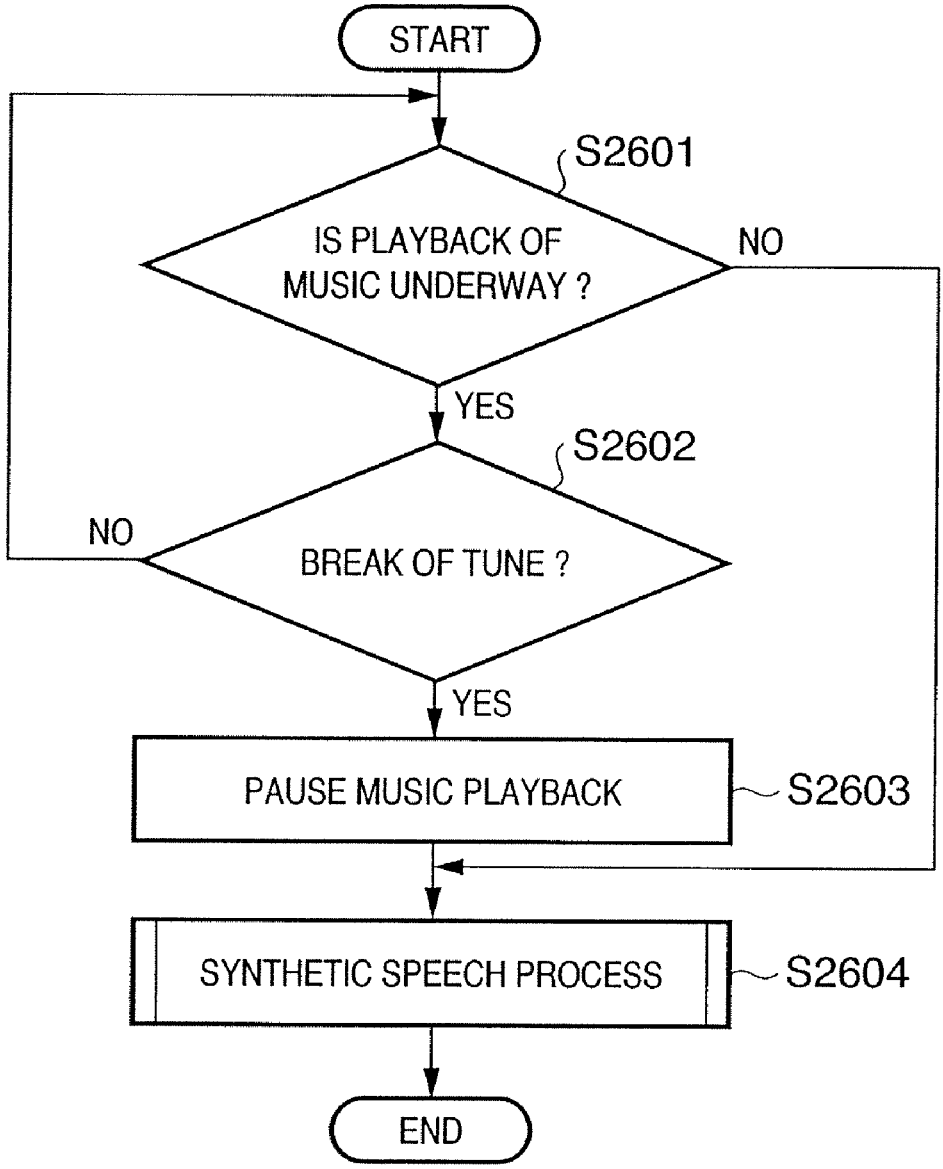
FIG. 24 is a flow chart showing an example of a process for controlling the output timing of synthetic speech in the third embodiment of the present invention.

FIG. 24 is a flow chart showing an example of the output timing control process of synthetic speech. This process is executed when the CPU 1 periodically checks if new information from the network 103 is stored in the RAM 3 that stores information, and finds the new information.

The CPU 1 checks in step S2601 if playback of music is in progress. If NO in step S2601, the flow jumps to step S2604 to immediately execute the speech synthesis process shown in FIG. 23, i.e., to read information by synthetic speech. If YES in step S2601, the flow advances to step S2602.

The CPU 1 checks in step S2602 if the music during playback has reached a break between neighboring tunes, i.e., a blank between neighboring tunes. If playback of a given tune is in progress, the flow returns to step S2601; otherwise, the flow advances to step S2603. In step S2603, playback of the music is paused, and the flow advances to step S2604 to immediately execute the speech synthesis process shown in FIG. 23, i.e., to read information by synthetic speech. After the information is read, playback of the music that has been paused is restarted.

Figure 25:
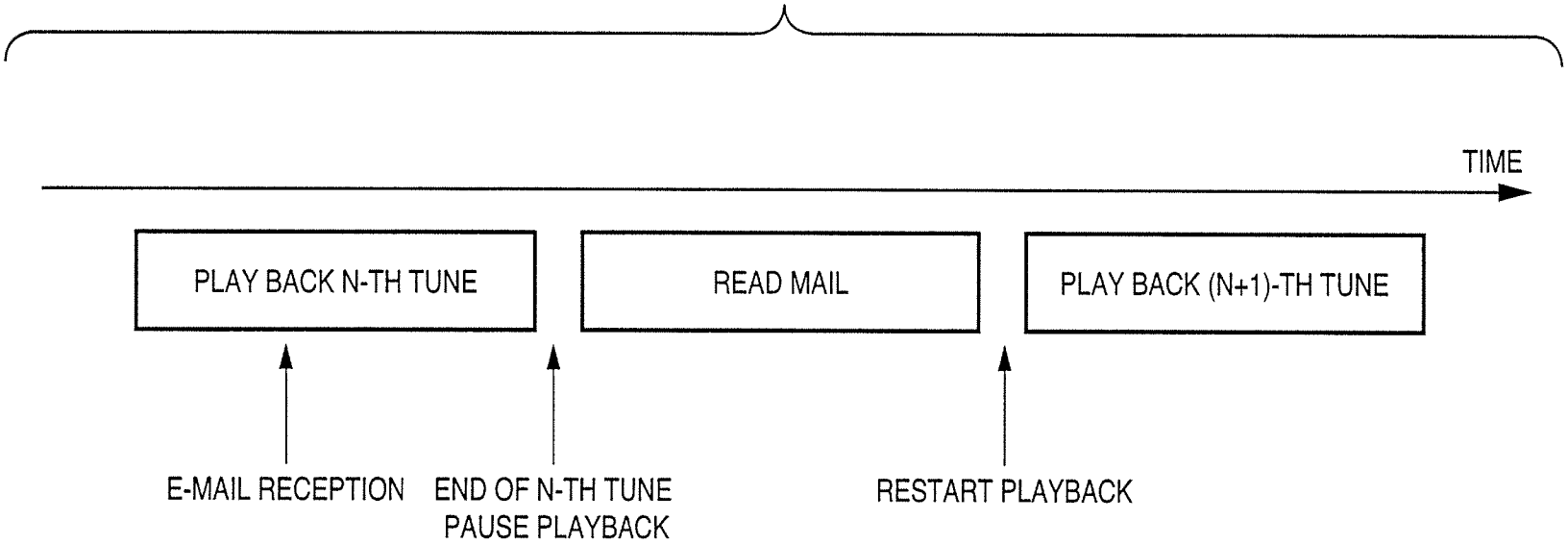
FIG. 25 is a timing chart of speech output from the speech output apparatus 100 upon executing the process shown in FIG. 24 in the third embodiment of the present invention.

FIG. 25 is a timing chart of speech and a piece of music to be output from the speech output apparatus 101 by the process shown in FIG. 24. FIG. 25 illustrates that an e-mail message is received during playback of the music of the N-th tune. Upon completion of playback of the N-th tune, the contents of the received e-mail message are read by synthetic speech in a break between neighboring tunes (N-th and (N+1)-th tunes). During this interval, playback of the next tune ((N+1)-th tune) is paused. Upon completion of reading, playback of the (N+1)-th tune is started.

As described above, according to this embodiment, since information is read by synthetic speech in a break between neighboring tunes, playback of the tune can be prevented from being suddenly interrupted, or the user can easily hear the synthetic speech since the synthetic speech is not superposed on the music. Since information is read by synthetic speech immediately after completion of a given tune, the received information can be quickly provided to the user.

In the process in FIG. 24, character data is converted into synthetic speech data after completion of a given tune, and synthetic speech is output. However, conversion of character data into synthetic speech data may be executed parallel to playback of a tune, and only the output process of synthetic speech may be executed after completion of that tune.

In the process in FIG. 24, playback of the music is paused in step S2603. However, if the volume of information to be read by synthetic speech is small and reading is expected to complete within the break time between neighboring tunes, playback need not be paused.

In this embodiment, information such as an e-mail message, news article, or the like sent from the network 103 is received, and is output as synthetic speech at a predetermined timing. The information to be output as the synthetic speech is not limited to such specific information, and includes various other kinds of information of which the user is to be notified. For example, information indicating the state of the speech output apparatus 101 such as the battery remaining amount or the like, information that the speech output apparatus 101 has already stored, and the like may be output.

<Another Example of Output Timing Control Process of Synthetic Speech>

In the process in FIG. 24, upon outputting synthetic speech of information during playback of music, the synthetic speech is fixedly output in a break between neighboring tunes. However, in case of urgent information, the contents of information are preferably read immediately. Also, less important information may be read later.

Figure 26:
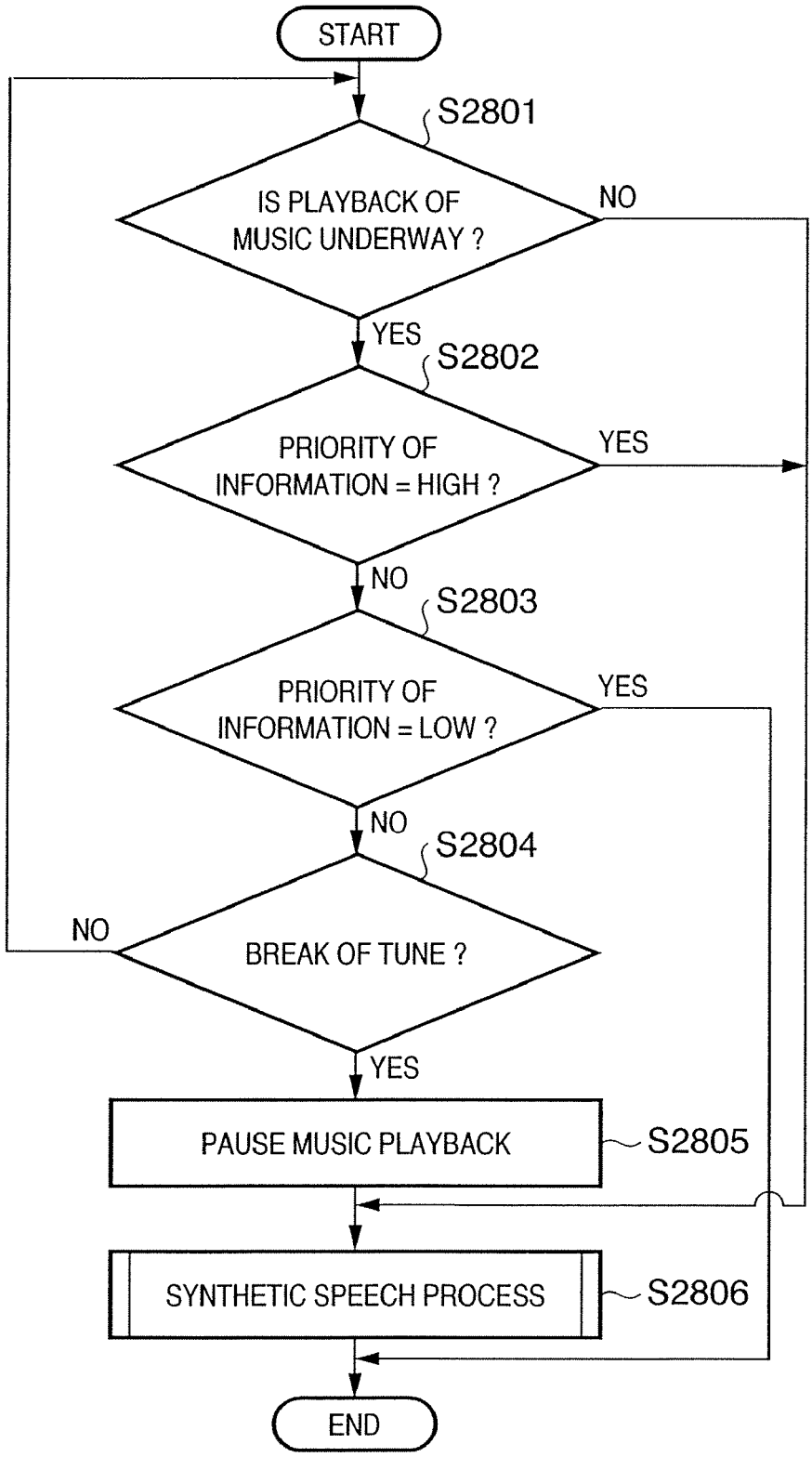
FIG. 26 is a flow chart showing another example of the process for controlling the output timing of synthetic speech in the third embodiment of the present invention.

In this example, the output timing of synthetic speech is controlled in accordance with the priority of information. FIG. 26 is a flow chart showing such process. In this example, three priority levels of information, i.e., low, middle, and high levels, are assumed.

The CPU 1 checks in step S2801 if playback of music is in progress. If NO in step S2801, the flow jumps to step S2806 to immediately execute the speech synthesis process shown in FIG. 23, i.e., to read information by synthetic speech. On the other hand, if YES in step S2801, the flow advances to step S2802.

The CPU 1 checks in step S2802 if the priority of the information to be output by synthetic speech is high. The priority level of information may be determined depending on the type of information. For example, an e-mail message may have a high priority level, a news article may have a middle priority level, and information such as an advertisement, sales, or the like may have a low priority level. Alternatively, the sender of information may append information indicating a priority level to information to be sent. For example, in case of an e-mail message, the sender may append information indicating a priority level to a mail header, and the priority level may be determined by checking the header.

If it is determined in step S2802 that the priority of the information is high, the flow jumps to step S2806 to immediately execute the speech synthesis process. In this case, the contents of the information are read by synthetic speech to be superposed on the music during playback, or the music can be stopped while the contents of the information are read. The user can quickly obtain the contents of the information.

If it is determined in step S2802 that the priority of the information is not high, the flow advances to step S2803, and the CPU 1 checks if the priority of the information is low. If YES in step S2803, the process ends, and the information remains stored in the RAM 2 or the like without being read by synthetic speech. The user will operate the apparatus to read the held information if he or she has an enough time.

If it is determined in step S2803 that the priority of the information is not low, the CPU 1 determines that the information has a middle priority level, and the flow advances to step S2804. The processes in steps S2804 to S2806 are the same as those in steps S2602 to S2604 in FIG. 24, and the contents of information are output as synthetic speech in a break between neighboring tunes.

As described above, according to this example, the reading timing of information by synthetic speech can be controlled in accordance with the priority of the information.

<Still Another Example of Output Timing Control Process of Synthetic Speech>

Figure 27:
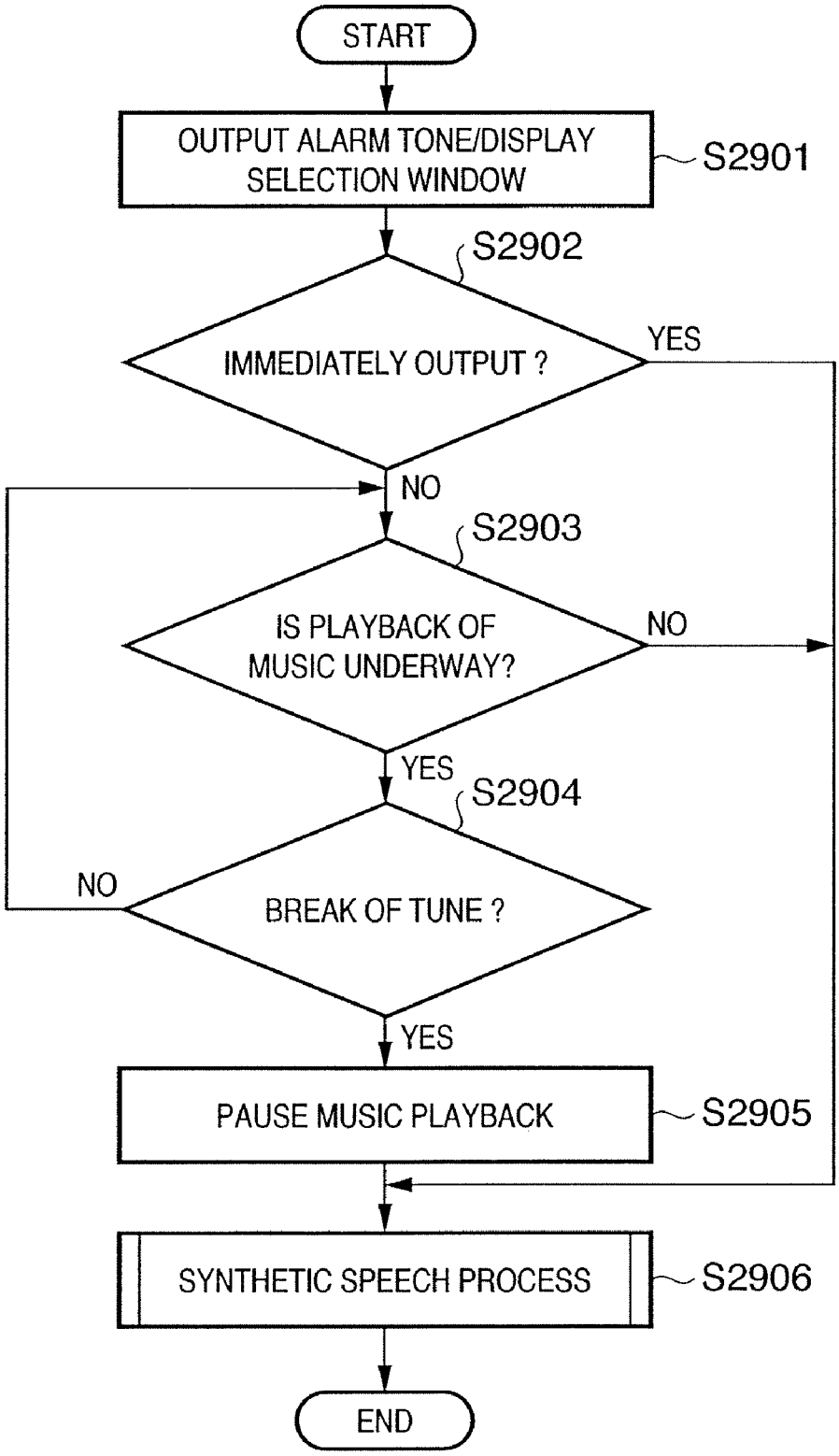
FIG. 27 is a flow chart showing still another example of the process for controlling the output timing of synthetic speech in the third embodiment of the present invention.

In the process in FIG. 26, the output timing of information by synthetic speech is controlled in accordance with the priority of the information. In this example, the user can select that timing. FIG. 27 is a flow chart showing that process.

If new information is stored in the RAM 2, the CPU 1 outputs predetermined data to the D/A converter 10 in step S2901 to generate an alarm tone via the loudspeaker 12. That is, the CPU 1 informs the user of the presence of new information. The informing pattern is not limited to the alarm tone, but may include display on the display 9, vibrations, and the like.

If playback of music is underway, an alarm tone is superposed on the music during playback. Also, a window for prompting the user to select whether or not the new information is immediately read by synthetic speech is displayed on the display 9.

Figure 28:
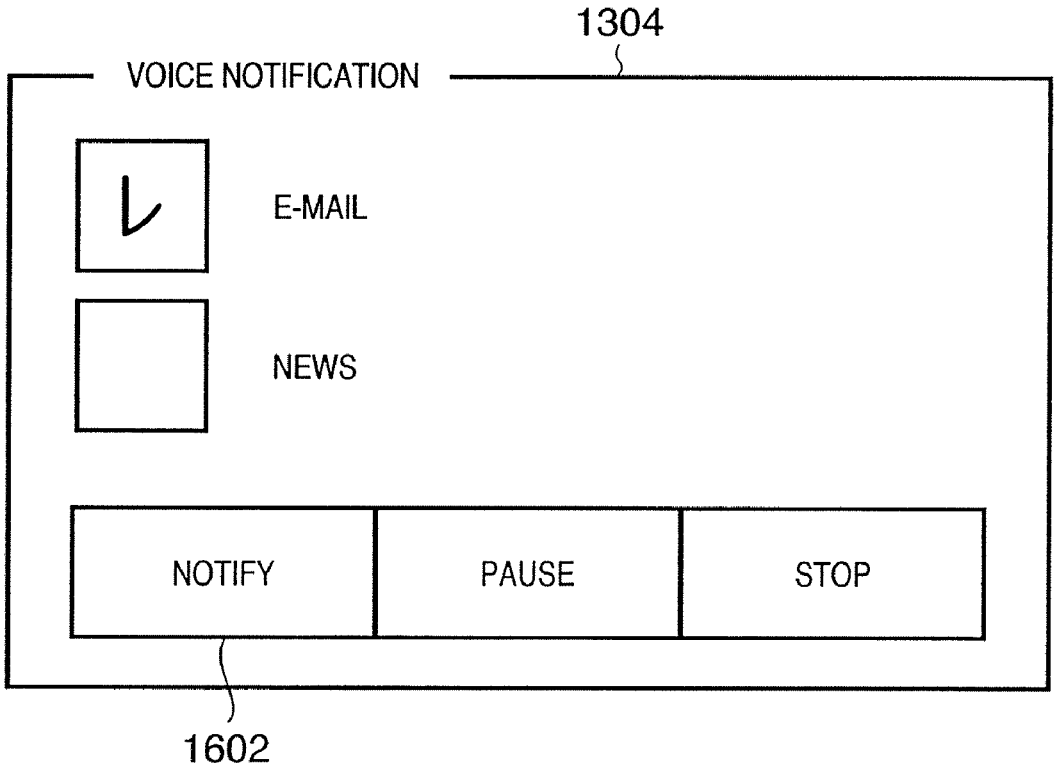
FIG. 28 shows a display example of an operation area 1304 displayed on the display 9 in step S901 in FIG. 27.

FIG. 28 shows a display example of such window, which is displayed on the operation area 1304 that has been explained with reference to FIG. 21. Unlike the display example in FIG. 21, a notify button 1602 is displayed. When the user wants to immediately output new information as synthetic speech, he or she presses this notify button 1602; otherwise, he or she does nothing.

Referring back to FIG. 27, the CPU 1 checks in step S2902 if the user has selected the immediate synthetic speech output of information. If the user has pressed the notify button 1602 on the display example of FIG. 28, the CPU 1 determines that the user has selected the immediate output, and the flow jumps to step S2906. In step S2906, the CPU 1 immediately executes the speech synthesis process in FIG. 23, and reads information by synthetic speech. If playback of music is underway, the contents of information are read by synthetic speech to be superposed on the music during playback.

On the other hand, if the user has not pressed the notify button 1602 within a predetermined period of time, the CPU 1 determines that the user has not selected the immediate output, and the flow advances to step S2903. The processes in steps S2903 to S2906 are the same as those in steps S2601 to S2604 in FIG. 24.

As described above, according to this example, the reading timing of information by synthetic speech can be controlled in accordance with user's favor.

Modification of Third Embodiment

Figure 29:
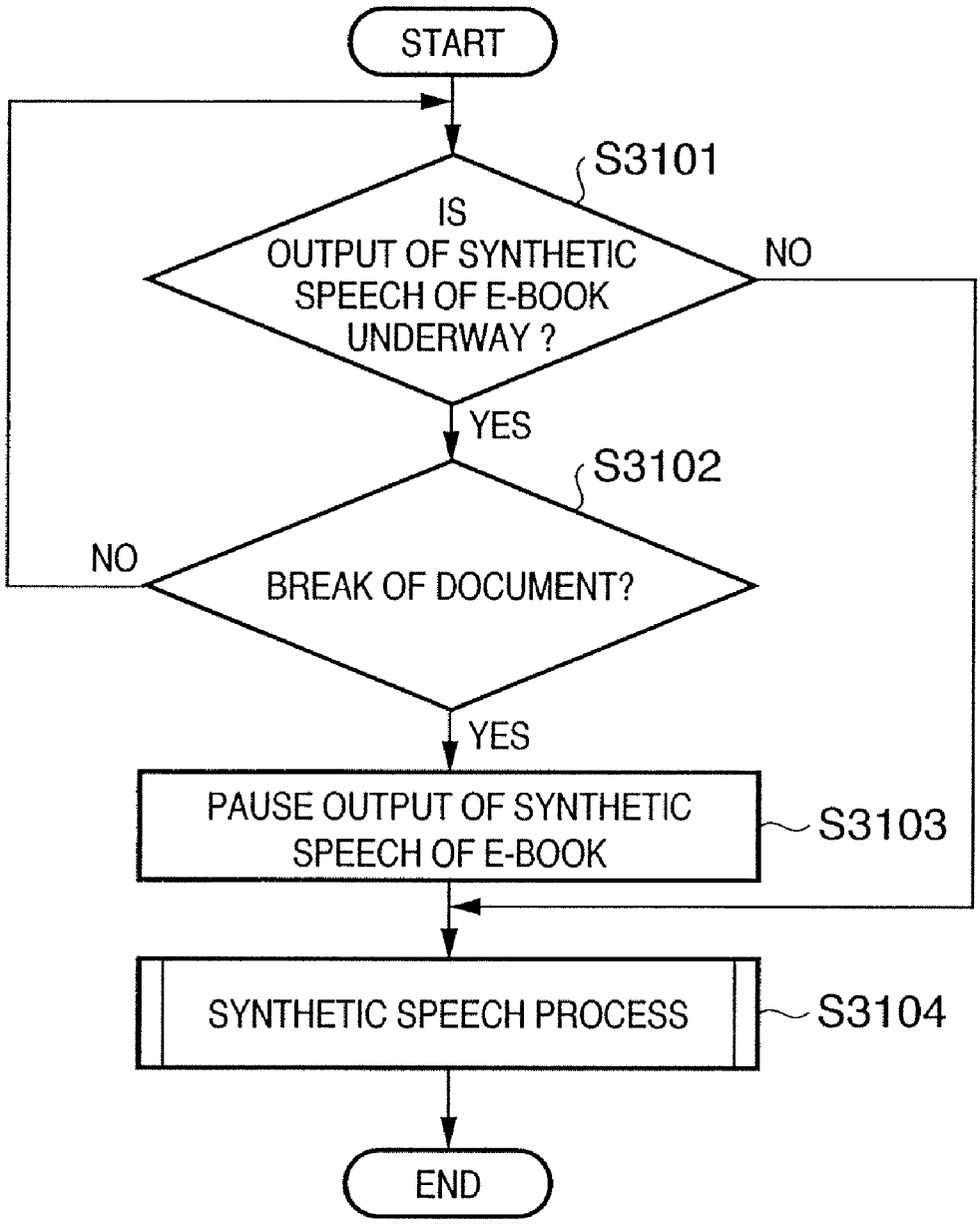
FIG. 29 is a flow chart showing an example of a timing control process when an e-book is output as synthetic speech in place of playback of music in the third embodiment of the present invention.

The processes described in the above embodiment are associated with those to be executed during playback of the music. However, the aforementioned processes may be executed during output of audio data other than music. In this modification, timing control upon outputting the contents of information by synthetic speech while an e-book is read by synthetic speech will be explained below. Also, a case will be explained below wherein an e-book is output as synthetic speech in place of playback of music in association with the process that has been explained with reference to FIG. 24. FIG. 29 is a flow chart showing an example of such process.

The CPU 1 checks in step S3101 if synthetic speech of an e-book is now being output. Note that the e-book data is stored in, e.g., the smart-media card 4*a*, and its character data undergo the speech synthesis process shown in FIG. 23, thus reading the e-book by synthetic speech.

If NO in step S3101, the flow jumps to step S3104, and the CPU 1 immediately executes the speech synthesis process in FIG. 23, thus reading the information by synthetic speech. On the other hand, if YES in step S3101, the flow advances to step S3102.

The CPU 1 checks in step S3102 if the reading position of the e-book, which is being output as synthetic speech, has reached a break of a document. The break of a document includes a position between neighboring chapters, a position between neighboring paragraphs, or the like. As a method of determining if the reading position has reached a break of a document, if an e-book is formed of, e.g., HTML data, and tags indicating chapters and paragraphs are appended, the break of a document can be determined by checking the presence/absence of such tag.

FIG. 30 shows an example in which an e-book is formed of XML data. In this e-book, <chapter>and </chapter>are appended as tags that indicate one chapter, and <paragraph>and </paragraph>are appended as tags that indicate one paragraph. Therefore, by detecting the presence/absence of such tag, whether or not the reading position has reached a break of a document can be determined.

If it is determined in step S3102 that the reading position has reached a break of a document, the flow advances to step S3103; otherwise, the flow returns to step S3101. In step S3103, the CPU 1 pauses the output of the synthetic speech of the e-book, and the flow then advances to step S3104. In step S3104, the CPU 1 executes the speech synthesis process in FIG. 23 to read the information by synthetic speech. If the e-book is being output as synthetic speech, the speech synthesis process is already launched. Hence, in the process in step S3104 in this case, data to be converted into synthetic speech data is merely changed from character data of the e-book to those of information.

After the information is read, the paused reading of the e-book by synthetic speech is restarted. In this case, reading is restarted from the paused reading position.

As described above, according to this embodiment, since the information is read by synthetic speech in a break of a document of an e-book, reading of the e-book can be prevented from being suddenly interrupted, or the user can easily hear the synthetic speech since the synthetic speech is not superposed on that of the e-book. Also, the received information can be quickly provided to the user.

In this embodiment, a case has been explained wherein information is output as synthetic speech during output of synthetic speech of an e-book in place of playback of music. Also, by the same method, the processes shown in FIGS. 26 and 27 can be executed during output of synthetic speech of an e-book in place of playback of music.

Another Embodiment

The preferred embodiments of the present invention have been explained. The objects of the present invention are also achieved by supplying a storage medium (or recording medium), which records a program code of a software program that can implement the functions of the above-mentioned embodiments to the system or apparatus, and reading out and executing the program code stored in the storage medium by a computer (or a CPU or MPU) of the system or apparatus.

In this case, the program code itself read out from the storage medium implements the functions of the above-mentioned embodiments, and the storage medium which stores the program code constitutes the present invention. The functions of the above-mentioned embodiments may be implemented not only by executing the readout program code by the computer but also by some or all of actual processing operations executed by an operating system (OS) running on the computer on the basis of an instruction of the program code.

Furthermore, the functions of the above-mentioned embodiments may be implemented by some or all of actual processing operations executed by a CPU or the like arranged in a function extension card or a function extension unit, which is inserted in or connected to the computer, after the program code read out from the storage medium is written in a memory of the extension card or unit.

As many apparently widely different embodiments of the present invention can be made without departing from the spirit and scope thereof, it is to be understood that the invention is not limited to the specific embodiments thereof except as defined in the claims.

What is claimed is:

1. A speech output apparatus comprising:

conversion means for converting character data into synthetic speech data;

output means for outputting music and synthetic speech based on the synthetic speech data; and control means for controlling an output timing of the synthetic speech, wherein said control means begins to output the synthetic speech after completion of output of a tune which is being output.

2. The apparatus according to claim 1, wherein said control means begins to output the synthetic speech at a timing between neighboring tunes during output of the music.

3. The apparatus according to claim 1, further comprising:

means for, when the synthetic speech begins to be output, pausing output of the next tune until the output of the synthetic speech ends.

4. The apparatus according to claim 1, further comprising:

reception means for receiving information, wherein said conversion means converts character data contained in the received information into synthetic speech data.

5. The apparatus according to claim 4, wherein the information is sent from a network.

6. The apparatus according to claim 4, further comprising:

means for, when the information is received, informing user of reception of the information.

7. The apparatus according to claim 4, further comprising:

means for checking a priority of the received information, wherein when the priority of the received information is a predetermined priority, said control means begins to output the synthetic speech of the information even during output of the music.

8. The apparatus according to claim 1, further comprising:

means for allowing a user to select an output timing of the synthetic speech, wherein said control means controls the output timing of the synthetic speech in accordance with the timing selected by the user.

9. A speech output apparatus comprising:

conversion means for converting character data into synthetic speech data;

output means for outputting synthetic speech based on the synthetic speech data; and control means for controlling an output timing of the synthetic speech, wherein when synthetic speech indicating contents of other information is to be output during output of synthetic speech indicating contents of an e-book, said control means begins to output the synthetic speech of the other information in a break of a document of the e-book which is being output.

10. The apparatus according to claim 9, further comprising:

means for, when the synthetic speech of the other information begins to be output, pausing output of the synthetic speech indicating the contents of the e-book until the output of the synthetic speech of the other information ends.

11. The apparatus according to claim 9, further comprising:

reception means for receiving the other information.

12. The apparatus according to claim 11, wherein the other information is sent from a network.

13. The apparatus according to claim 11, further comprising:

means for, when the other information is received, informing a user of reception of the other information.

14. The apparatus according to claim 11, further comprising:

means for checking a priority of the received other information, and wherein when the priority of the received other information is a predetermined priority, said control means begins to output the synthetic speech of the other information received even during output of the synthetic speech indicating the contents of the e-book.

15. The apparatus according to claim 9, further comprising:

means for allowing a user to select an output timing of the synthetic speech of the other information, wherein said control means controls the output timing of the synthetic speech of the other information in accordance with the timing selected by the user.

16. A speech output method comprising:

a conversion step of converting character data into synthetic speech data;

an output step of outputting music and synthetic speech based on the synthetic speech data; and a control step of controlling an output timing of the synthetic speech, wherein the control step includes a step of beginning to output the synthetic speech after completion of output of a tune which is being output.

17. A speech output method comprising:

a conversion step of converting character data into synthetic speech data;

an output step of outputting synthetic speech based on the synthetic speech data; and a control step of controlling an output timing of the synthetic speech, wherein the control step includes a step of, when the synthetic speech indicating contents of other information is to be output during output of synthetic speech indicating contents of an e-book, beginning to output the synthetic speech of the other information in a break of a document of the e-book which is being output.

18. A computer readable medium storing a program for making a computer execute:

in order to control an output timing of synthetic speech indicating contents of information, in a case of outputting the synthetic speech and music, a step of checking if the music is being output; and a step of, when it is determined that the music is being output, beginning to output the synthetic speech after the end of a tune which is being output.

19. A computer readable medium storing a program for execute:

in order to control an output timing of synthetic speech indicating contents of information, in a case of outputting the synthetic speech indicating the contents of the information and synthetic speech indicating contents of an e-book, a step of checking if the synthetic speech indicating the contents of the e-book is being output; and a step of, when it is determined that the synthetic speech indicating the contents of the e-book is being output, beginning to output the synthetic speech indicating the contents of the information in a break of a document of the e-book which is being output.

* * * * *